US012588728B2

(12) United States Patent
Lombardi et al.

(10) Patent No.: US 12,588,728 B2
(45) Date of Patent: Mar. 31, 2026

(54) HARD HAT COMMUNICATION SYSTEM

(71) Applicant: Milwaukee Electric Tool Corporation, Brookfield, WI (US)

(72) Inventors: Samuel L. Lombardi, Milwaukee, WI (US); Caleb R. Meadows, Milwaukee, WI (US); Brandon L. Feil, Brookfield, WI (US); Todd Andrew Zeilinger, Wauwatosa, WI (US); Addie M. Payne, Milwaukee, WI (US); Jesse J. Brown, Milwaukee, WI (US); Hunter Blaise Schaufel, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 19/049,739

(22) Filed: Feb. 10, 2025

(65) Prior Publication Data

US 2025/0241399 A1 Jul. 31, 2025

Related U.S. Application Data

(63) Continuation of application No. PCT/US2025/013333, filed on Jan. 28, 2025.

(60) Provisional application No. 63/634,563, filed on Apr. 16, 2024, provisional application No. 63/564,123, filed on Mar. 12, 2024, provisional application No. 63/626,190, filed on Jan. 29, 2024.

(51) Int. Cl.
*A42B 3/30* (2006.01)

(52) U.S. Cl.
CPC ..... *A42B 3/30* (2013.01)

(58) Field of Classification Search
CPC ..... A42B 1/018; A42B 3/30
See application file for complete search history.

(56) References Cited

U.S. PATENT DOCUMENTS

| | | | |
|---|---|---|---|
| 3,845,389 | A | 10/1974 | Phillips et al. |
| 3,889,190 | A | 6/1975 | Palmer |
| 3,916,312 | A | 10/1975 | Campbell |
| 4,374,301 | A | 2/1983 | Frieder, Jr. |

(Continued)

FOREIGN PATENT DOCUMENTS

| | | |
|---|---|---|
| CN | 201928272 | 8/2011 |
| CN | 102871255 | 1/2013 |

(Continued)

OTHER PUBLICATIONS

International Search Report and Written Opinion for International Application No. PCT/US2025/013333, dated May 13, 2025, 11 pages.

*Primary Examiner* — Katherine M Moran
(74) *Attorney, Agent, or Firm* — Reinhart Boerner Van Deuren s.c.

(57) ABSTRACT

Various embodiments of a hard hat communication system are provided. The hard hat includes a shell having an external surface and an internal surface that defines a cavity sized to receive the head of a wearer. In various embodiments, the communication system is mounted and/or integrated into the shell. In various embodiments, the communication system is mounted and/or integrated into a chin strap coupled to the hard hat. In various embodiments, the communication system is mounted and/or integrated into a suspension system supported within the cavity of the hard hat.

20 Claims, 28 Drawing Sheets

(56) References Cited

U.S. PATENT DOCUMENTS

| | | | | |
|---|---|---|---|---|
| 4,524,461 | A | 6/1985 | Kostanty et al. | |
| 5,404,577 | A | 4/1995 | Zuckerman et al. | |
| 5,678,205 | A | 10/1997 | Gray | |
| 6,104,816 | A | 8/2000 | Down, Jr. et al. | |
| 6,298,249 | B1 | 10/2001 | Locarno et al. | |
| 7,110,743 | B2 | 9/2006 | Depew et al. | |
| 8,166,575 | B2 * | 5/2012 | Haselmayer | A42B 3/166 2/10 |
| 8,194,875 | B2 | 6/2012 | Miranda | |
| 8,600,094 | B2 | 12/2013 | Kushnirov et al. | |
| 8,618,936 | B2 | 12/2013 | Niederer, III et al. | |
| 9,013,297 | B1 | 4/2015 | Dey et al. | |
| 9,177,458 | B1 | 11/2015 | Dey et al. | |
| 9,219,768 | B2 | 12/2015 | Hobby et al. | |
| 9,356,706 | B2 | 5/2016 | Stolarczyk et al. | |
| 9,389,677 | B2 | 7/2016 | Hobby et al. | |
| 9,486,027 | B2 | 11/2016 | Dey et al. | |
| 9,538,800 | B2 | 1/2017 | Dey et al. | |
| 9,538,801 | B2 | 1/2017 | Dey et al. | |
| 9,642,574 | B2 | 5/2017 | Zhavoronkov et al. | |
| 9,814,278 | B2 | 11/2017 | Chung et al. | |
| 10,158,685 | B1 | 12/2018 | Hobby et al. | |
| 10,168,417 | B2 | 1/2019 | Bulumulla et al. | |
| 10,327,497 | B1 | 6/2019 | Florez | |
| 10,383,384 | B2 | 8/2019 | Zhavoronkov et al. | |
| 10,413,011 | B2 | 9/2019 | Jordan | |
| 10,418,828 | B2 | 9/2019 | Schadow et al. | |
| 10,484,652 | B2 | 11/2019 | Hobby et al. | |
| 10,667,571 | B2 | 6/2020 | Sengupta et al. | |
| 10,743,599 | B2 * | 8/2020 | Silva | F21V 15/04 |
| 10,912,344 | B2 * | 2/2021 | Bohn | A42B 3/222 |
| 11,000,088 | B2 | 5/2021 | Dey et al. | |
| 11,013,289 | B1 | 5/2021 | Lucero | |
| 11,019,870 | B2 * | 6/2021 | Hyma | A42B 3/044 |
| 11,103,021 | B2 * | 8/2021 | Le | A42B 3/0406 |
| 11,116,270 | B2 | 9/2021 | Zhavoronkov et al. | |
| 11,213,087 | B2 * | 1/2022 | Hyma | A42B 3/0446 |
| 11,266,199 | B2 | 3/2022 | Wong | |
| 11,452,327 | B2 * | 9/2022 | Deshpande | A42B 3/0446 |
| 11,452,328 | B2 | 9/2022 | Franzino et al. | |
| 11,539,117 | B1 * | 12/2022 | Demarest | H01Q 7/00 |
| 11,583,023 | B2 * | 2/2023 | Jones | A42B 3/0406 |
| 11,627,776 | B2 | 4/2023 | Macferren, III | |
| 11,930,879 | B2 | 3/2024 | Franzino et al. | |
| 11,937,660 | B2 * | 3/2024 | Zeilinger | A42B 3/223 |
| 12,009,852 | B2 | 6/2024 | Medeiros et al. | |
| 12,156,560 | B2 * | 12/2024 | Summersett | H01M 50/202 |
| 12,178,274 | B2 * | 12/2024 | Lombardi | A42B 3/04 |
| 12,201,175 | B2 * | 1/2025 | Summersett | A42B 3/227 |
| 12,336,586 | B2 * | 6/2025 | Zeilinger | A42B 3/0406 |
| 12,349,754 | B2 * | 7/2025 | Philibert | A42B 3/223 |
| 2006/0121950 | A1 | 6/2006 | Lee | |
| 2007/0182664 | A1 | 8/2007 | Himmele | |
| 2009/0199317 | A1 | 8/2009 | Schwiers et al. | |
| 2010/0075619 | A1 | 3/2010 | Solla et al. | |
| 2010/0258601 | A1 * | 10/2010 | Thrope | A45F 5/00 224/267 |
| 2012/0210498 | A1 | 8/2012 | Mack | |
| 2014/0355807 | A1 | 12/2014 | McDowell | |
| 2016/0090839 | A1 | 3/2016 | Stolarczyk | |
| 2017/0202293 | A1 | 7/2017 | Rossi, Jr. | |
| 2017/0367433 | A1 | 12/2017 | Frett | |
| 2019/0037954 | A1 | 2/2019 | Friedman et al. | |
| 2019/0075879 | A1 | 3/2019 | Persson et al. | |
| 2022/0015488 | A1 * | 1/2022 | Adams | A42B 3/063 |
| 2022/0132973 | A1 | 5/2022 | Wong | |
| 2022/0295934 | A1 * | 9/2022 | Adams | A42B 3/166 |
| 2023/0157398 | A1 | 5/2023 | Lombardi et al. | |
| 2023/0221123 | A1 | 7/2023 | Gabriel et al. | |
| 2023/0320452 | A1 | 10/2023 | Ketterer et al. | |
| 2024/0206581 | A1 | 6/2024 | Yoo et al. | |
| 2024/0324711 | A1 | 10/2024 | Medeiros et al. | |
| 2024/0389704 | A1 | 11/2024 | Franzino et al. | |
| 2024/0423310 | A1 * | 12/2024 | Lombardi | A42B 3/0406 |

FOREIGN PATENT DOCUMENTS

| | | |
|---|---|---|
| CN | 202857947 | 4/2013 |
| CN | 202980317 | 6/2013 |
| CN | 203555225 | 4/2014 |
| CN | 204070724 | 1/2015 |
| CN | 105124849 | 12/2015 |
| CN | 205337768 | 6/2016 |
| CN | 205512594 | 8/2016 |
| CN | 205787808 | 12/2016 |
| CN | 106360873 | 2/2017 |
| CN | 107277755 | 10/2017 |
| CN | 107348595 | 11/2017 |
| CN | 206651433 | 11/2017 |
| CN | 107951113 | 4/2018 |
| CN | 108813783 | 11/2018 |
| CN | 208301040 | 1/2019 |
| CN | 208354715 | 1/2019 |
| CN | 209436337 | 9/2019 |
| CN | 209807235 | 12/2019 |
| CN | 209823745 | 12/2019 |
| CN | 209965345 | 1/2020 |
| CN | 210094783 | 2/2020 |
| CN | 210248560 | 4/2020 |
| CN | 210672215 | 6/2020 |
| CN | 211631926 | 10/2020 |
| CN | 212325590 | 1/2021 |
| CN | 112425857 | 3/2021 |
| CN | 212678484 | 3/2021 |
| CN | 212754472 | 3/2021 |
| CN | 213074659 | 4/2021 |
| CN | 112754096 | 5/2021 |
| CN | 213405028 | 6/2021 |
| CN | 214340419 | 10/2021 |
| CN | 114128952 | 3/2022 |
| CN | 216315857 | 4/2022 |
| CN | 217364809 | 9/2022 |
| CN | 115969130 | 4/2023 |
| CN | 116464510 | 7/2023 |
| CN | 219438298 | 8/2023 |
| CN | 116746729 | 9/2023 |
| CN | 116763037 | 9/2023 |
| CN | 116784556 | 9/2023 |
| CN | 116961749 | 10/2023 |
| CN | 220403204 | 1/2024 |
| CN | 117859989 | 4/2024 |
| CN | 221599318 | 8/2024 |
| CN | 118716727 | 10/2024 |
| DE | 29818794 | 1/1999 |
| WO | WO9725832 | 7/1997 |
| WO | WO12017836 | 2/2012 |
| WO | WO16145703 | 9/2016 |
| WO | WO17055804 | 4/2017 |
| WO | WO24126780 | 6/2024 |

* cited by examiner

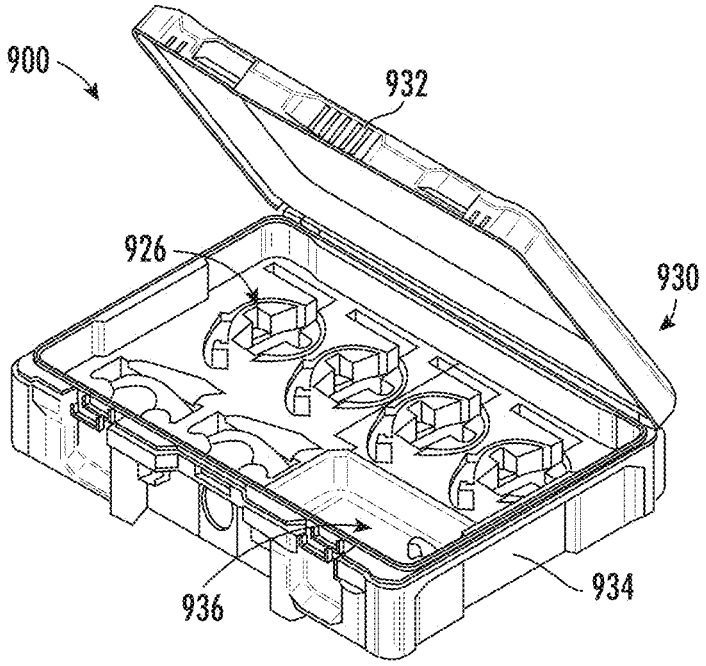
FIG. 20
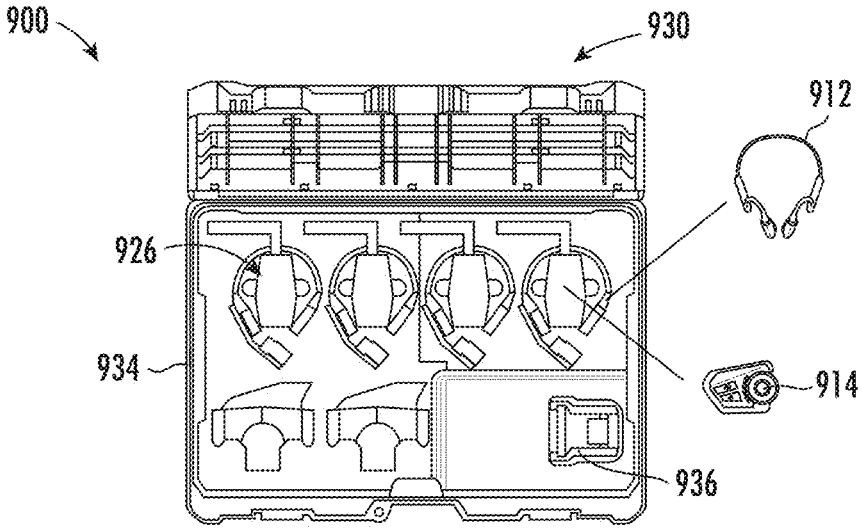
FIG. 21
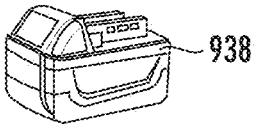

HARD HAT COMMUNICATION SYSTEM

CROSS-REFERENCE TO RELATED PATENT APPLICATIONS

The present application is a continuation of International Application No. PCT/US2025/013333 filed on Jan. 28, 2025, which claims the benefit of and priority to U.S. Provisional Application No. 63/634,563, filed Apr. 16, 2024, to U.S. Provisional Application No. 63/564,123, filed on Mar. 12, 2024, and to U.S. Provisional Application No. 63/626,190, filed on Jan. 29, 2024, which are incorporated herein by reference in their entireties.

BACKGROUND OF THE INVENTION

The present invention relates generally to the field of hard hats. The present invention relates specifically to a communication system that can be mounted and/or integrated with the hard hat, the shell, the suspension, the chin strap, accessories mounted to the hard hat etc.

SUMMARY OF THE INVENTION

One embodiment of the invention relates to a hard hat system. The hard hat system includes a hard hat and a communication system. The hard hat includes an outer shell with an exterior surface and an interior surface that defines a cavity. The cavity is configured to receive a head of a wearer. The hard hat includes a crown that has a front side and a rear side. The crown is configured to cover part of the head of the wearer, with a bottom portion of the crown defining a lower circumference along the exterior surface. The hard hat further includes a mounting ridge extending outward from at least one of the front side and the rear side of the exterior surface of the hard hat. The mounting ridge includes a first edge spaced apart from the exterior surface and a second edge spaced apart from the exterior surface. The hard hat includes an auxiliary mounting ridge positioned on a lateral side of the bottom portion of the crown. The auxiliary mounting ridge includes a plurality of mounting ports positioned along the auxiliary mounting ridge. The communication system includes a communicator and a headset. The communicator is supported by the mounting ridge or the auxiliary mounting ridge. The headset is configured to be used with the communicator.

Another embodiment of the invention relates to a hard hat system. The hard hat system includes a hard hat, a communicator, and a headset. The hard hat includes an outer shell with an exterior surface and an interior surface that defines a cavity. The cavity is sized to receive a head of the user. The hard hat includes a crown portion configured to cover part of the head of the user. A bottom segment of the crown portion defines a lower circumference extending along the exterior surface of the outer shell. A mounting ridge is positioned on a lateral side of the bottom segment. The mounting ridge includes a first end, a second end, and a plurality of slots positioned along the mounting ridge between the first end and the second end. The communicator is supported by the mounting ridge. The headset is configured to be used with the communicator Another embodiment of the invention relates to a hard hat system. The hard hat system includes a hard hat, a communicator, and a headset. The hard hat includes an outer shell with an exterior surface and an interior surface that defines a cavity. The outer shell further includes a crown portion having a bottom segment that defines a lower circumference extending along the exterior surface of the outer shell. The hard hat further includes a mounting ridge positioned on a lateral side of the bottom segment. The mounting ridge includes a first end, a second end, and at least two slots positioned along the mounting ridge between the first end and the second end. The communicator is supported by one of the at least two slots of the mounting ridge. The headset is configured to be supported by the hard hat.

Additional features and advantages will be set forth in the detailed description which follows, and will be readily apparent to those skilled in the art from the description or recognized by practicing the embodiments as described in the written description and/or shown in the accompany drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which:

FIG. 20 is a perspective view of a mobile storage charger for a communication system, according to an exemplary embodiment.

FIG. 21 is a top view of the mobile storage charger of FIG. 20 and communication system, according to an exemplary embodiment.

DETAILED DESCRIPTION

Figure 1:
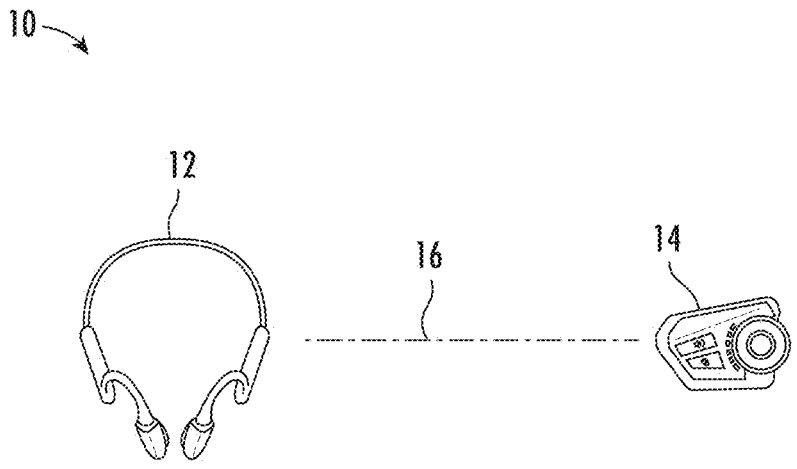
FIG. 1 is a portion of a communication system, according to an exemplary embodiment.

Referring generally to the figures, various embodiments of a hard hat communication system are provided. In contrast to typical communication systems that are used on job or constructions sites where the devices may be shared, the charger and/or docking station is configured to modify the settings of the individual communication devices to allow for easier pairing to individual users or groups of users. In various specific embodiments, communicators charged in a charging station are automatically configured to communicate to each other. In such embodiments, communicators charged in different charging stations are automatically configured to not communicate to each other. Applicant believes the automatic device set up improves efficiency on a work site where multiple communication devices are frequently in use and shared. Instead of group coordination or requiring set up of the communication devices every day, the communication devices are paired and ready for use when removed from the charging station.

In various embodiments, the communication system includes a near-field communication (NFC) tag to allow for storing personalized user data for shared the communication devices. Applicant believes for shared worksite communication devices, storage of personalized data with the user rather than the shared device improves efficiency and reduces confusion for works who will not be required to reset the communication devices to their personal preferences on a daily basis. In a specific embodiment, the user's personal data is stored on an NFC tag coupled to a hard hat. When the communicator is placed near the tag the personalized data can be read by the communicator. In various other embodiments, a component including storage (e.g., memory) and a communications interface is permanently coupled to the user's hard hat. In such embodiments, when the communicator or shared device is connected to the component coupled to the hard hat, personalized information is read from the storage.

Furthermore, Applicant believes mounting and/or integrating the communication system with the hard hat, the shell, the suspension, the chin strap, etc. improves safety and efficiency by allowing for hands free communication. For example, the ability to take phone calls, communicate with other workers, listen to entertainment (e.g., radio, podcasts, music, etc.) without requiring use of hands or the distraction of another device (e.g., phone) improves communication without jeopardizing the situational awareness of the worker. Additionally, Applicant believes the integration into personal protective equipment such as a hard hat provides a light weight communication solution that does not interfere with other critical equipment such as tool belts. Finally, Applicant believes the integration of communication systems within the hard hat or hard hat components provides better proximity to the ears and mouth of a user improving the quality of communication.

In various embodiments, the communication system allows for connecting and disconnecting the communication system or device (e.g., with a magnet or simple audio jack/connector) at different times (i.e., hard hat followed by headset or headset followed by hard hat) reducing the likelihood of the device becoming entangled and allowing for quick and easy removal of any tangles in the communication system components. In various embodiments, the communication system or device is designed to be symmetrical. Applicant believes the symmetry allows individual users freedom to mount the communication system based on personal preference and allow for control with either the left or right hand.

In various embodiments, the communication system includes an adjustable band sizing for increased comfort and fit of the wearer and a proper fit (e.g., tight) to reduce the likelihood of snagging the system components on the work site.

In various embodiments, the communication system uses bone conduction technology. Applicant believes the use of bone conduction allows for supplementing of standard air conduction audio delivery that may be hampered by the use of hearing protection (earmuffs, ear plugs, etc.). In various specific embodiments, the bone conduction transducers are integrated into the hard hat and/or liner. Applicant believes integration into the hard hat or liner allows workers to use hearing protection without impacting their ability to communicate.

In various specific embodiments, the bone conduction transducers are integrated into an earmuff. Applicant believes integration into earmuffs allows for a worker to wear both earplugs and earmuffs simultaneously in extremely loud environments while maintaining the ability to hear communications. Additionally, Applicant believes that because earmuffs are light weight and comfortable, workers are more likely to wear hearing protection over a longer period of time (e.g., the entire work day). Finally, Applicant believes the integration of the bone conduction transducer in the earmuff cushion allows for the earmuff to maintain the proper sealing to a user's skin for the necessary noise reduction rating (NRR).

Figure 2:
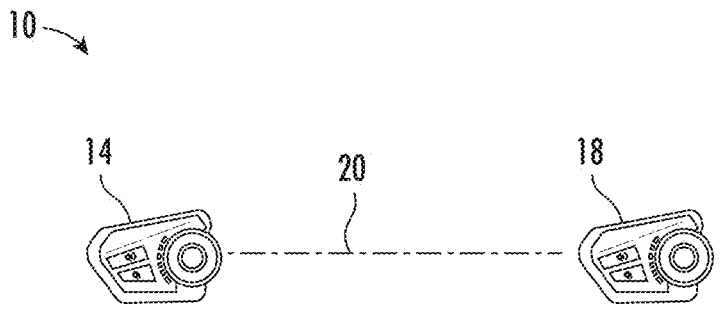
FIG. 2 is a communication system, according to another exemplary embodiment.
Figure 3:
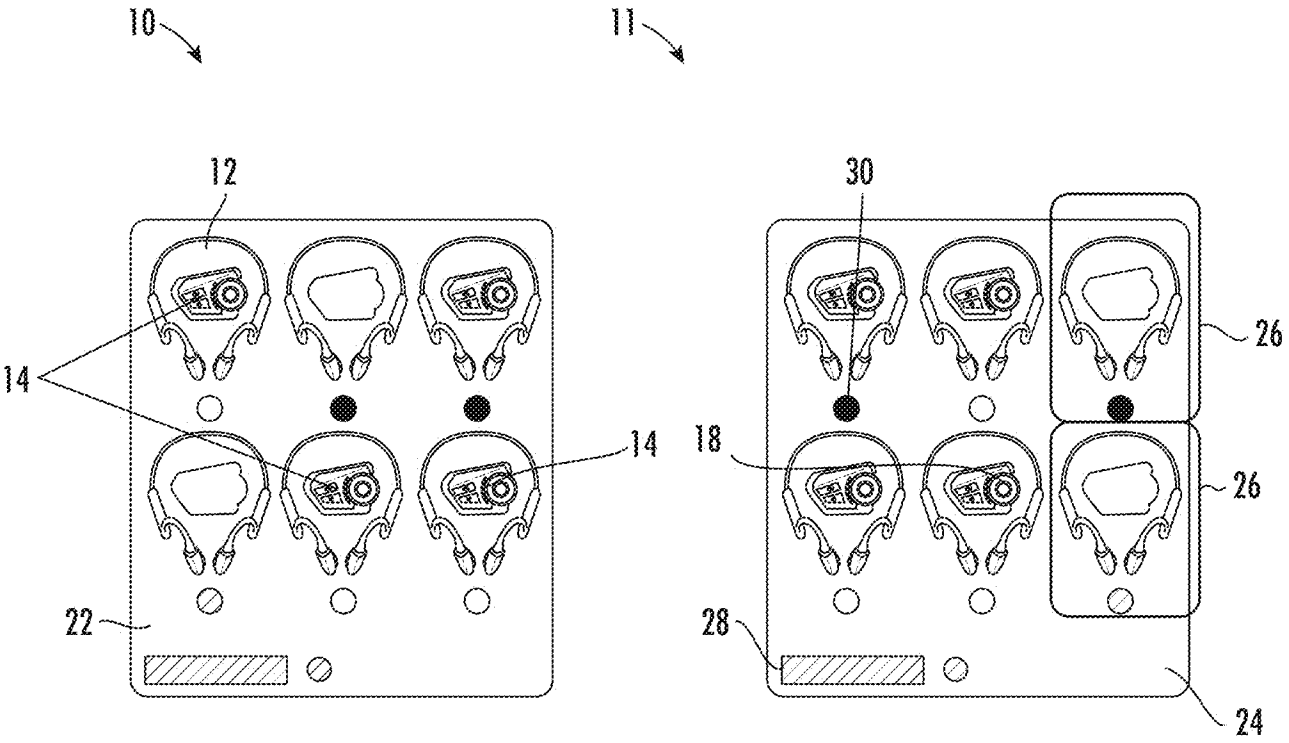
FIG. 3 is a charging system for the communication system, according to an exemplary embodiment.

Referring to FIGS. 1-3, a communication system 10 including a charging system 11 is shown according to an exemplary embodiment. Communication system 10 includes a headset 12 and a communicator 14. In various specific embodiments, headset 12 communicates 16 to a communicator device or communicator 14 wirelessly (e.g., Wi-fi, RF, Bluetooth, etc.). In specific embodiments, headset 12 is paired with communicator 14 using Bluetooth.

As will be generally understood, on work or job sites, numerous workers have their own communicator device. A first communicator 14 communicates to a second communicator 18 wirelessly. In various specific embodiments, the first communicator 14 and second communicator 18 are configured to be in the same talking group or channel 20. For example, in a specific embodiment, communicator 14 and communicator 18 are part of a mesh network.

Referring to FIG. 3, details of charging system 11 are shown according to an exemplary embodiment. In various specific embodiments, a first charger or base station 22 is configured to receive and charge headset 12 and communicator 14. In various embodiments, charging system includes a second charger or base station 24 configured to receive and charge headset 12 and communicators 14, 18.

Each charger 22, 24 includes one or more bays 26 sized to receive a headset 12 and a communicator 14. A headset 12 charged in the same bay 26 as a communicator 14 will only work or communicate with each other and not need to be paired with another communication device. In other words, if a headset 12 previously paired with a communicator 14 is placed in a bay 26 with another communicator 14, the original communicator 14 is forgotten. All of the communicators 14 charged within first charger 22 automatically have their settings updated to communicate with the other communicators 14 charged within first charger 22. In contrast, because communicator 18 is charged in second charger 24, communicator 18 is automatically configured (e.g., programmed) to not communicate with communicator 14 that has been charged in a different charger (e.g., first charger 22).

Each charger 22, 24 includes an interface 28, shown schematically, to allow a user to change device settings. Each bay 26 includes an indicator, shown as status light 30. In various specific embodiments, status light 30 is used to indicate whether a headset 12 has been paired with a communicator 14, 18. When a headset 12 is paired with a communicator 14, 18 the status light 30 is green and when the headset 12 is not paired with a communicator 14, 18 the status light 30 is red.

Figure 4:
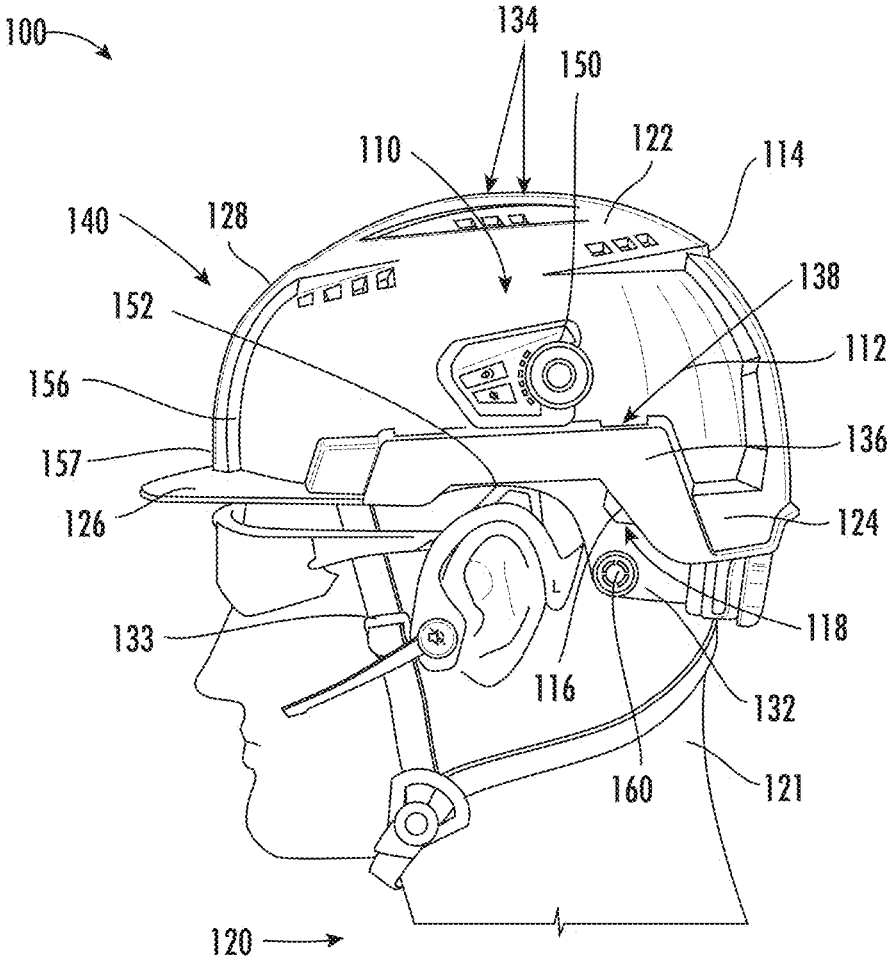
FIG. 4 is a side view of a hard hat supporting a communication system on the head of a wearer, according to an exemplary embodiment.

Referring to FIG. 4, a side view of a protective work or construction helmet, shown as hard hat 100 supporting a communication system 110 is shown, according to an exemplary embodiment. Hard hat 100 includes an outer shell 112. In a specific embodiment, outer shell 112 is formed from a rigid material, such as a rigid polymer material. In various specific embodiments, outer shell 112 is formed from one of high-density polyethylene (HDPE), acrylonitrile-butadine-styrene (ABS), polycarbonate (PC), polycarbonate/acrylonitrile-butadine-styrene (PC-ABS), and polypropylene (PP). Outer shell 112 includes an exterior surface 114 and an interior surface 116. Interior surface 116 defines a cavity 118 sized to receive a head 121 of a user and/or wearer 120. Outer shell 112 includes a crown portion 122 and a bottom segment 124 defining a lower circumference of hard hat 100.

In various embodiments, a suspension system 132 supports and secures hard hat 100 to the wearer's 120 head 121. In specific embodiments, a chin strap 133 is coupled to hard hat 100 and is secured around head 121 of user 120. Outer shell 112 further includes a plurality of apertures or vents 134. Vents 134 extend through outer shell 112 providing fluid communication between cavity 118 and the ambient air proximate to exterior surface 14 of outer shell 112.

In various embodiments, hard hat 100 includes a front mounting ridge 140 positioned on the front 128 of outer shell 112. Front mounting ridge 140 includes a first or right edge 156 protruding outwardly from the front mounting ridge 140 and a second or left edge 156 opposing the right edge 156 and protruding outwardly from the front mounting ridge 140. In a specific embodiment, front mounting ridge 140 includes a detent 157 positioned between the right edge 156 and the left edge 156 and configured to interface with an accessory mounting bracket and/or an accessory. The right edge 156 and left edge 156 of the front mounting ridge 140 each extend toward the bottom segment 124 of the outer shell 112. The right edge 156 and left edge 156 each include a portion with an increased width as the right edge 156 and left edge 156 approach the bottom segment 124 and/or the lip or brim 126. In various embodiments, hard hat 100 includes a rear mounting ridge that is substantially the same as front mounting ridge 140.

In various embodiments, hard hat 100 includes a side accessory support ridge or auxiliary mounting ridge 136 is positioned on a lateral side of outer shell 112 along the bottom segment 124. In various embodiments, an auxiliary mounting ridge 136 is positioned along both lateral sides of outer shell 112. Auxiliary mounting ridge 136 includes a first end and a second end opposing the first end. A plurality of apertures or slots 138 are positioned along auxiliary mounting ridge 136 between the first end and the second end. In a specific embodiment, auxiliary mounting ridge 136 includes three slots 138. In specific embodiments, auxiliary mounting ridge 136 includes at least two slots 138.

Communication system 110 includes a communicator 150 and a headset 152. In various specific embodiments, the communication system 110 uses bone conduction technology. In various embodiments, communicator 150 is supported by hard hat 100 and specifically by auxiliary mounting ridge 136. In specific embodiments, communicator 150 is supported by and/or coupled to a slot 138 of auxiliary mounting ridge 136. In various embodiments, an accessory is supported by the slot 138 and/or the auxiliary mounting ridge 136. In various embodiments, an accessory is coupled to and supported by a lot 138 of the mounting ridge 136. In various embodiments, an accessory is supported by the front mounting ridge 140 and/or the auxiliary mounting ridge 136. In specific embodiments, the accessory is one of a face shield, earmuffs, clip, tool, eyeglass holder, lamp support, brackets, etc.

In various embodiments, communicator 150 is mounted to hard hat 100 and more specifically to auxiliary mounting ridge 136 by a mounting element such as a clip. In various specific embodiments, the bone conduction transducers are integrated into headset 152 that is coupled to hard hat 100. Specifically, headset 152 is mounted to auxiliary mounting ridge 136 and/or a slot 138. In various specific embodiments, the bone conduction transducers are integrated into hard hat 100. In a specific embodiment, the conduction transducers are integrated into outer shell 112. In various other embodiments, the bone conduction transducer 160 is integrated into suspension system 132. In various other embodiments, the bone conduction transducers are integrated into chin strap 133.

Figure 5:
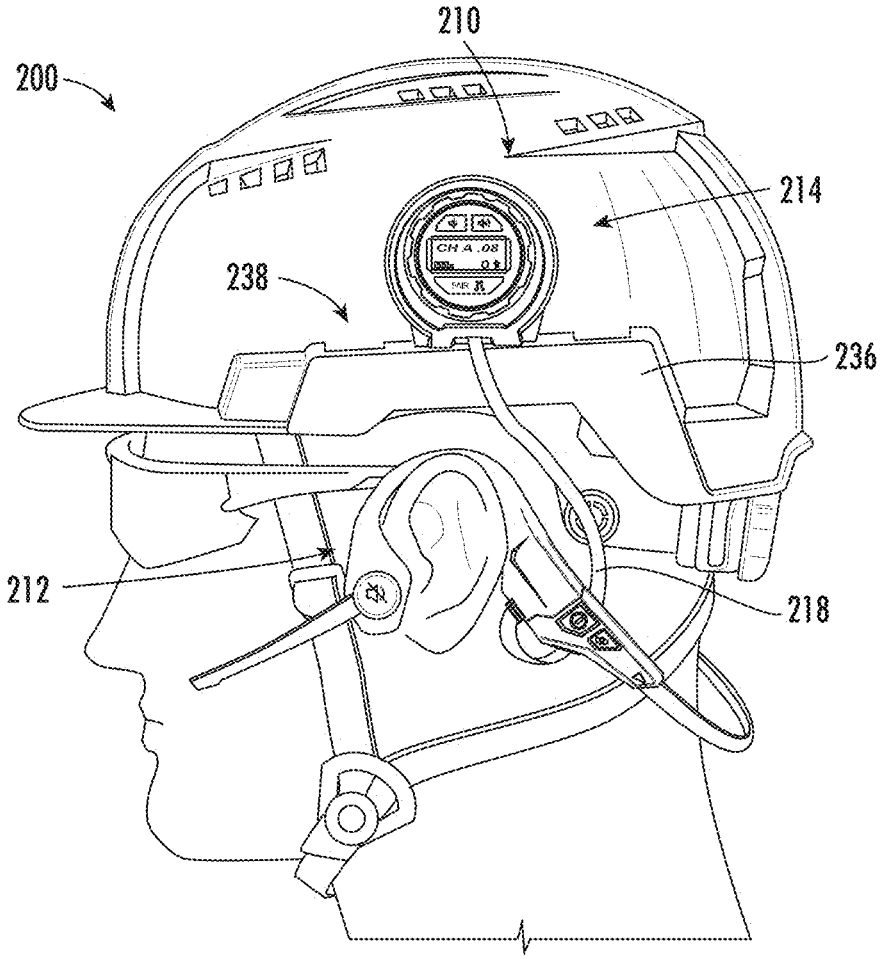
FIG. 5 is a side view of a hard hat supporting a communication system on the head of a wearer, according to another exemplary embodiment.
Figure 6:
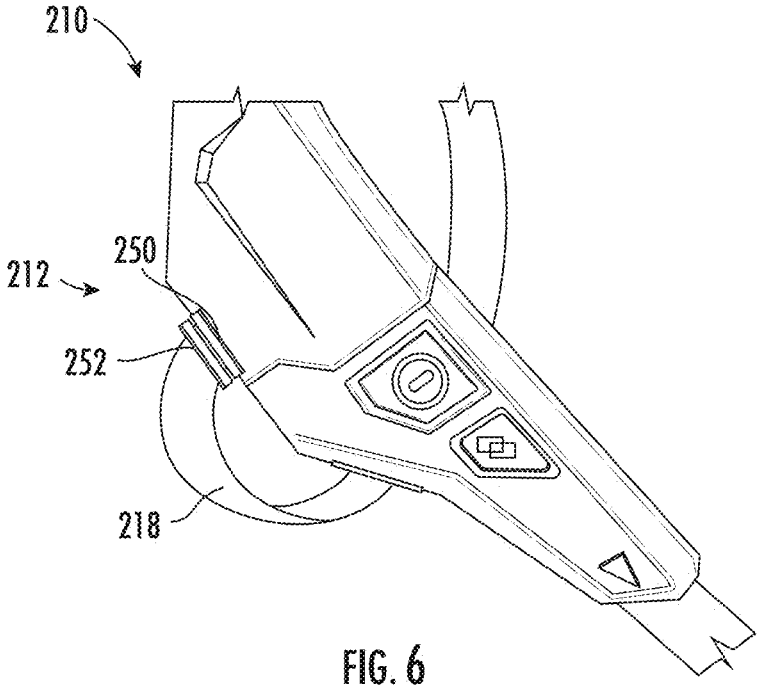
FIG. 6 is a detailed view of a headset according to an exemplary embodiment.
Figure 7:
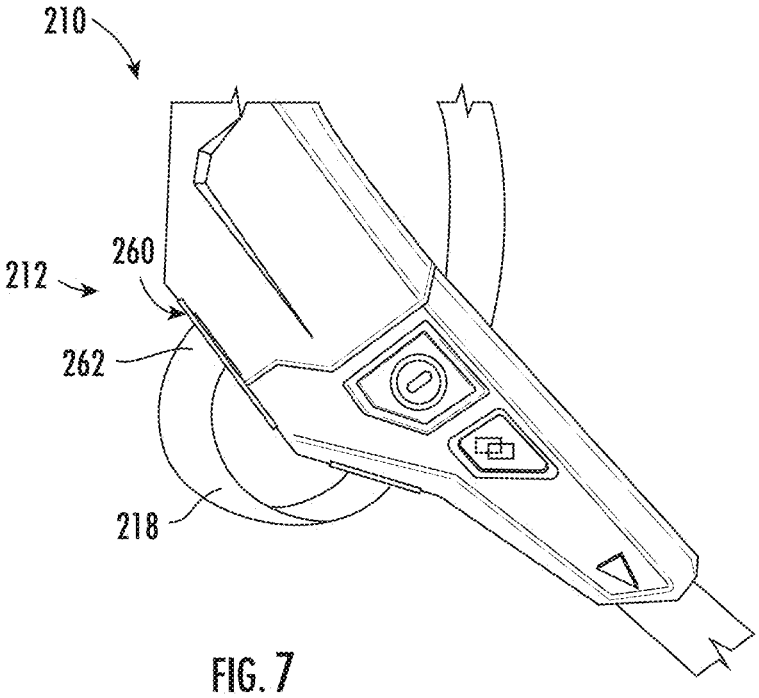
FIG. 7 is a detailed view of a headset according to another exemplary embodiment.

Referring to FIGS. 5-7, details of a hard hat 200 supporting a communication system 210 are shown according to an exemplary embodiment. Hard hat 200 is substantially the same as hard hat 100 except for the differences discussed herein. The communication system 210 allows for connecting and disconnecting the communication system 210 or communication device 214 at different times reducing the likelihood of the communicator 214 becoming entangled and allowing for quick and easy removal of any tangles in the communication system 210 components.

In various specific embodiments, when communicator 214 is positioned within auxiliary mounting ridge 236 a connector, shown as wire 218 extends between and connects communicator 214 to headset 212. Applicant believes the position of wire 218 reduces entanglement problems while reducing weight and costs of communication system 210 because the wired connection means that headset 212 does not require independent batteries, controls, etc. Furthermore, Applicant believes that using a flexible wire 218 allows for correct placement of headset 212 (e.g., on the ear) to work effectively and comfort for the user.

As shown in FIG. 6, in specific embodiments, wire 218 includes a magnetic component, shown as magnet 252 that is configured to be magnetically coupled to a magnetic dock 250 on headset 212. As shown in FIG. 7, in various other embodiments, wire 218 includes an audio jack 262 configured to connect to a port 260 in headset 212. In a specific embodiment, audio jack 262 is a male connector and port 260 is a female input.

Figure 8:
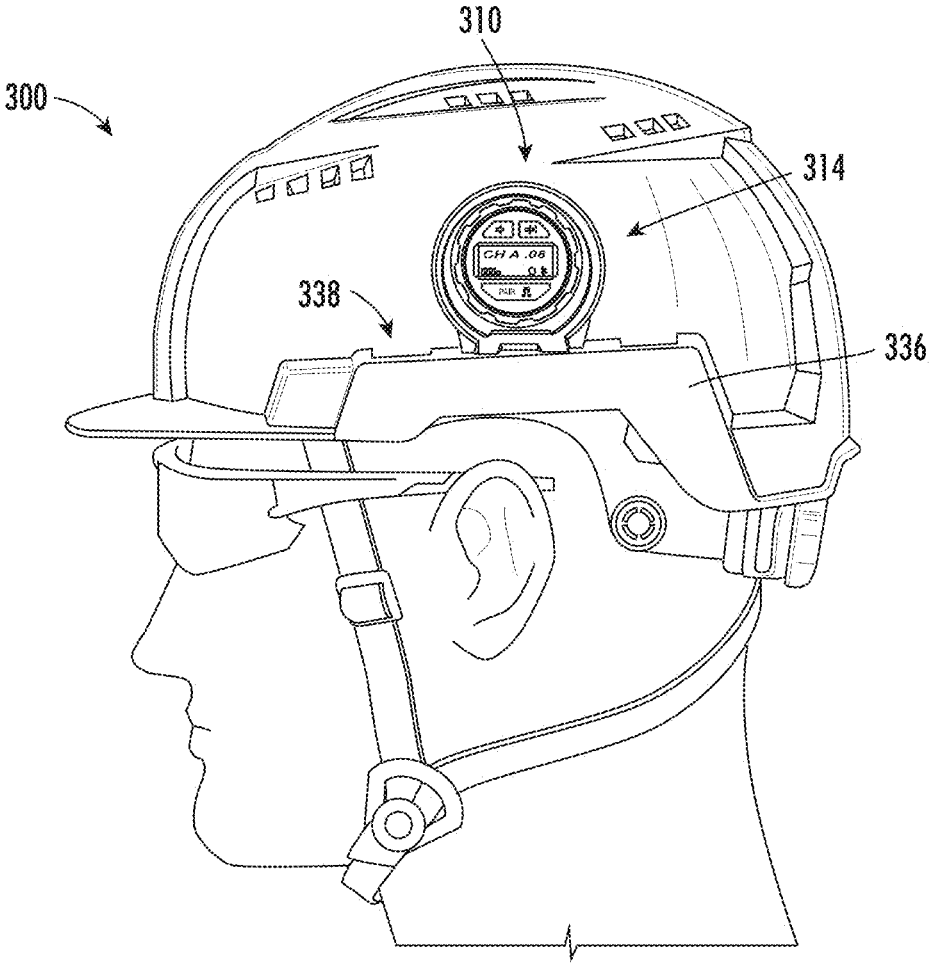
FIG. 8 is a side view of a hard hat supporting a communication system on the head of a wearer, according to another exemplary embodiment.
Figure 9:
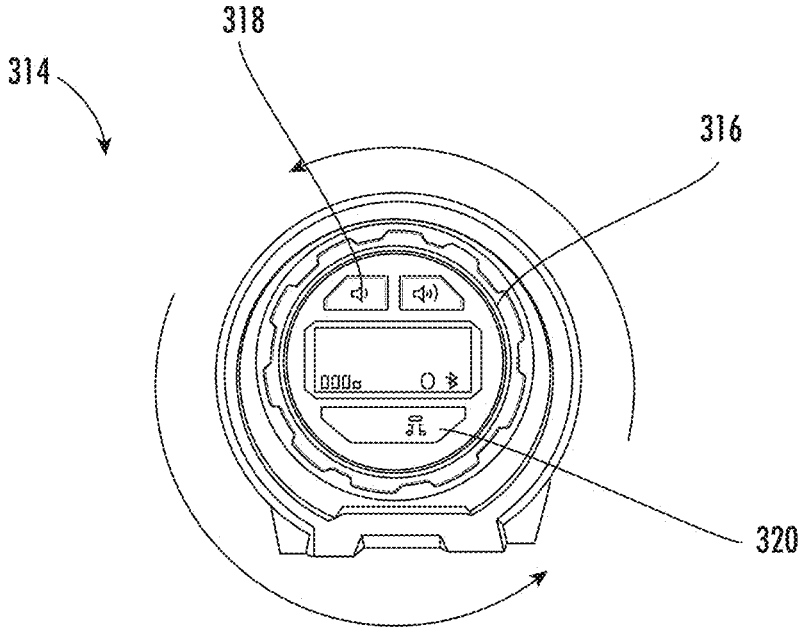
FIG. 9 is a detailed view of a communicator, according to an exemplary embodiment.

Referring to FIGS. 8-9, details of a hard hat 300 supporting a communication system 310 are shown according to an exemplary embodiment. Hard hat 300 is substantially the same as hard hat 100 except for the differences discussed herein. The communication system 310 includes a communication device or communicator 314 that can be pair with a headset (see e.g., elements 12, 212).

In various specific embodiments, communicator 314 is designed to be symmetrical. In various specific embodiments, communicator 314 can be mounted to helmet 300 using either auxiliary mounting ridge 336 (e.g., left auxiliary mounting ridge or right auxiliary mounting ridge). Communicator 314 includes a dial 316 that can be rotating in a clockwise and/or counterclockwise direction to alter the settings of communicator 314. In a specific embodiment, when dial 316 is pushed inward, (e.g., toward hard hat 300) and held for an amount of time (e.g., a few seconds) the communicator 314 is turned on or off.

In various specific embodiment, dial 316 can be utilized to change the mesh network, group, channel, the communicator 314 is connected to. Communicator 314 further includes volume buttons 318 to allow for volume adjustment and a pairing button 320 to allow for pairing to a headset.

Figure 10:
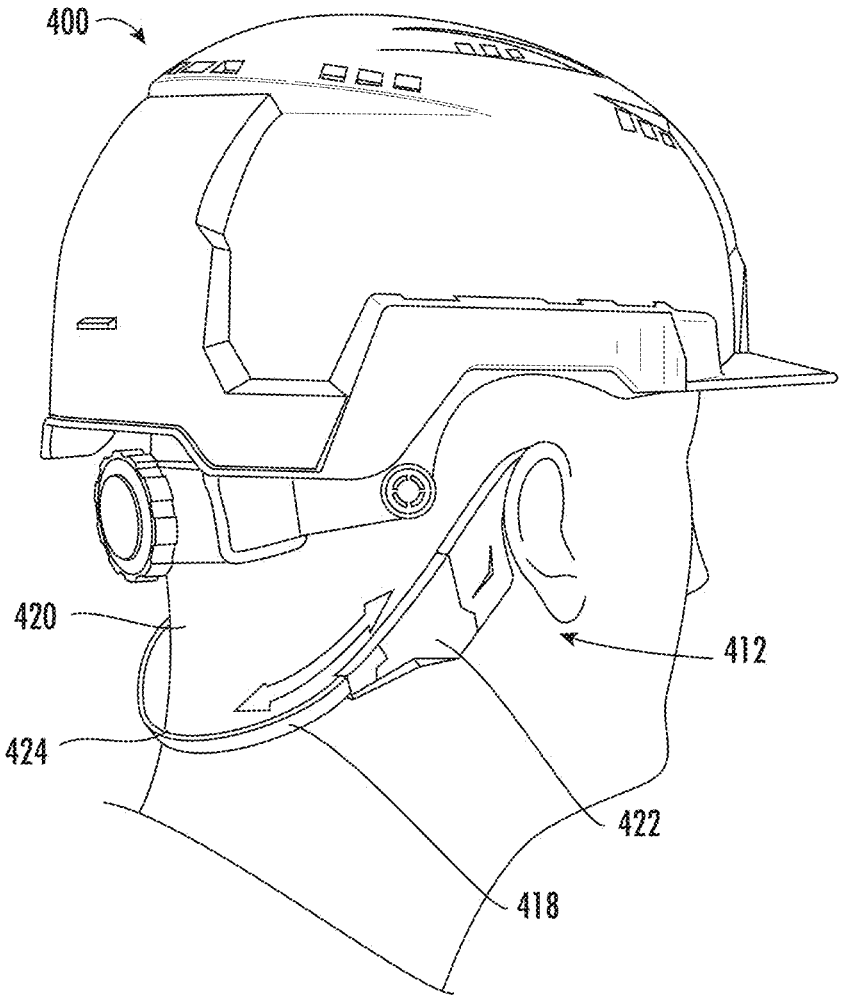
FIG. 10 is rear perspective view of an adjustable headset, according to an exemplary embodiment.

Referring to FIG. 10, a rear perspective view of an adjustable headset 412 is shown according to an exemplary embodiment. Adjustable headset 412 can be utilized with communication systems 10, 110, 210 and 310. Headset 412 is configured to extend around the back of the head or neck of wearer 420. Adjustable headset 412 includes a pair of engagement ends 422 configured to secure headset 412 to a wearer 420 and specifically to the ears of the wearer 420 and a connector 424.

Connector 424 extends between and connects the opposing engagement ends 422. A wire 418 similarly extends between the opposing engagement ends 422 and is housed within connector 424. In a specific embodiment, each end of connector 424 is received within an engagement end 422. When a wearer 420 needs to adjust the size of headset 412, either end of connector 424 can be pushed and/or received within an engagement end 422. In other words, headset 412 has dual telescoping end adjustment.

Figure 11:
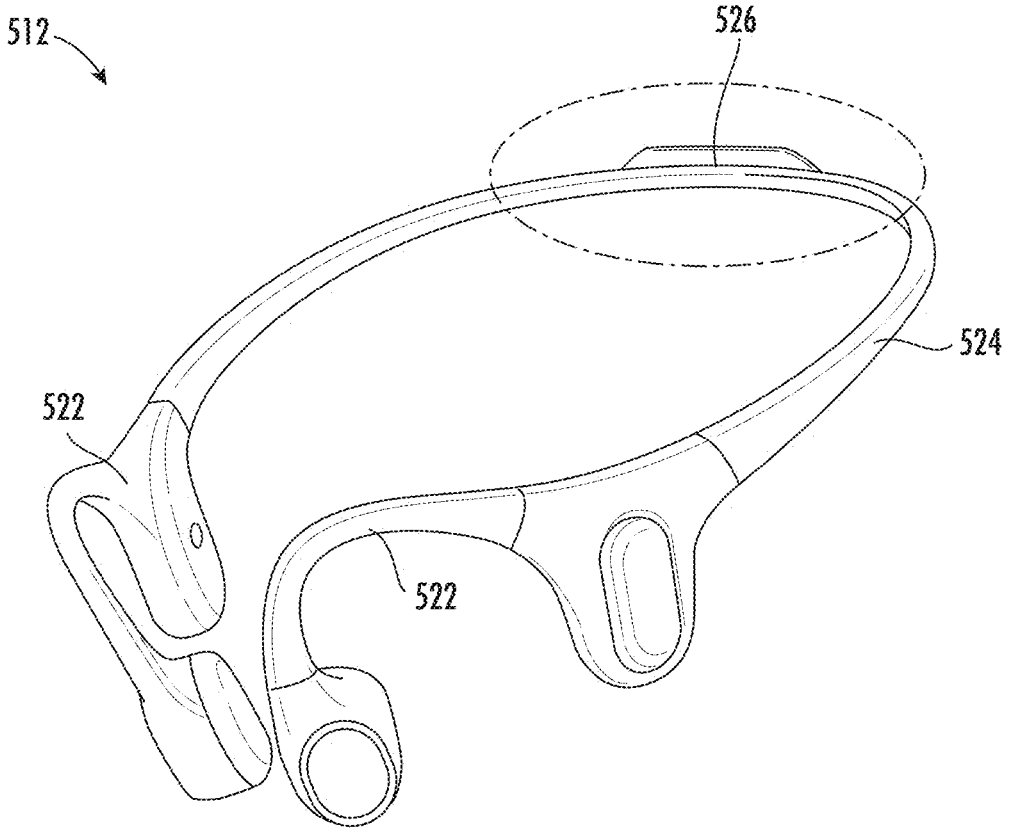
FIG. 11 is a perspective view of an adjustable headset, according to another exemplary embodiment.
Figure 12:
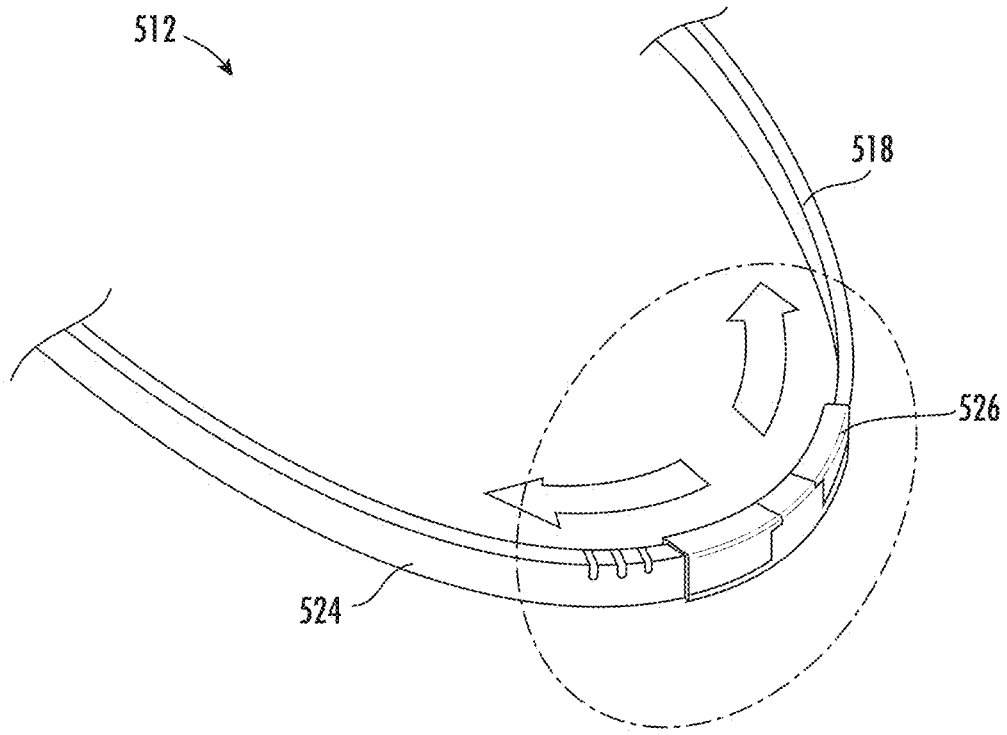
FIG. 12 is a detailed rear perspective view of the adjustable headset of FIG. 11, according to an exemplary embodiment.

Referring to FIGS. 11-12, a perspective view of an adjustable headset 512 is shown according to an exemplary embodiment. Adjustable headset 512 can be utilized with communication systems 10, 110, 210 and 310. Headset 512 is configured to extend around the back of the head or neck of a wearer. Adjustable headset 512 includes a pair of engagement ends 522 configured to secure headset 512 to the wearer and specifically to the ears of the wearer. Headset 512 includes a connector or band 524 extends between and connects the opposing engagement ends 522. A wire 518 similarly extends between the opposing engagement ends 522 and is housed within connector 524.

Headset 512 further includes a single adjuster 526 that is configured to change the size of headset 512 and specifically connector 524. In other words, adjuster 526 provides a single telescoping adjustment mechanism along the rear portion of connector 524. In various specific embodiments, connector 524 is a rigid hoop frame that provides inward pressure such that the appropriate contact force with a user (e.g., cheekbones, etc.) is provided. When adjuster 526 is moved, wire 518 expands and/or contracts inside connector 524. In other words, wire 518 has accordion like behavior as adjuster 526 is moved.

Figure 13:
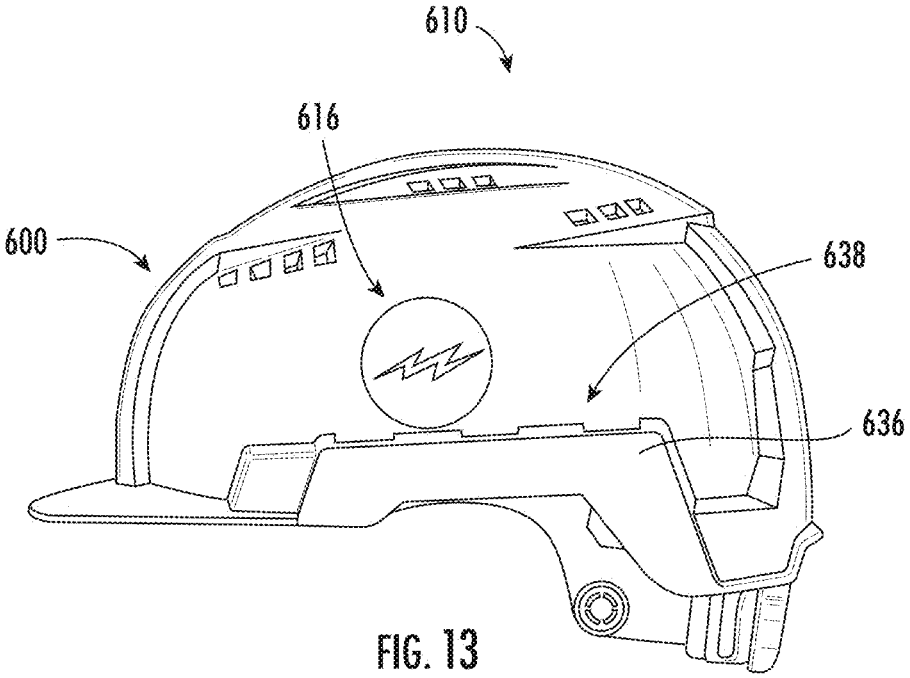
FIG. 13 is a side view of a hard hat supporting a portion of a communication system, according to another exemplary embodiment.
Figure 14:
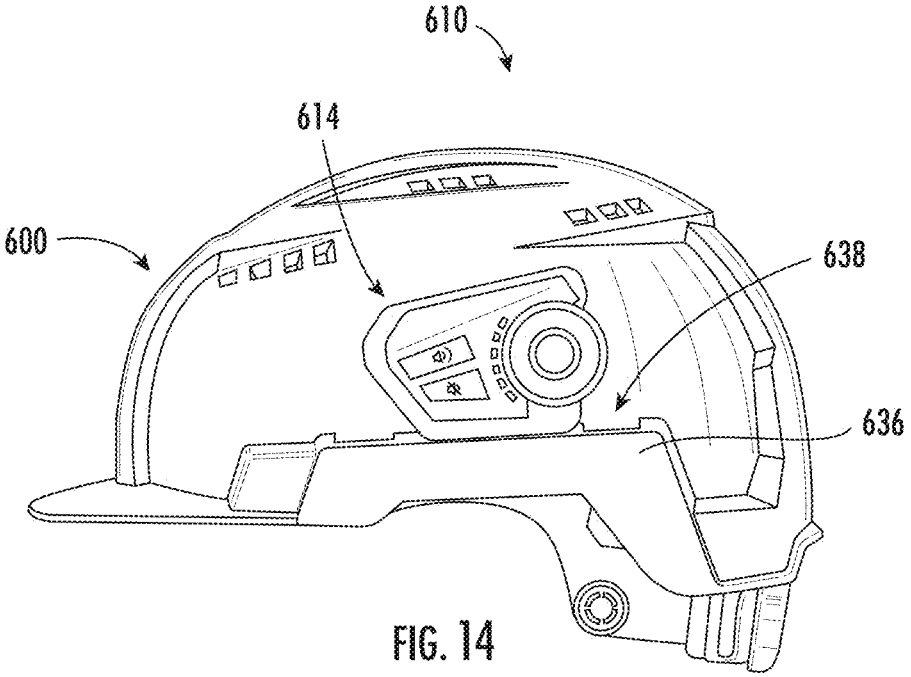
FIG. 14 is a side view of the hard hat of FIG. 12 supporting a communicator, according to an exemplary embodiment.

Referring to FIGS. 13-14, a side view of a protective work or construction helmet, shown as hard hat 600 supporting a communication system 610 is shown, according to an exemplary embodiment. Hard hat 600 is substantially the same as hard hat 100 except for the differences discussed herein. Communication system 610 includes a storage device, shown as a near-field communication (NFC) tag 616. As previously noted, Applicant believes using a storage or memory device improves worker efficiency by allowing for storing personalized user data for shared the communication devices.

In a specific embodiment, the NFC tag 616 is coupled to hard hat 600 adjacent to auxiliary mounting ridge 636. In a specific embodiment, the NFC tag 616 is positioned on an exterior surface of hard hat 600 adjacent to auxiliary mounting ridge 636 and configured to store a user's data. When communicator 614 is placed near NFC tag 616, the personalized data stored within NFC tag 616 is read by communicator 614 (see e.g., FIG. 14). In other words, communicator 614 is supported by at least one slot 638 of auxiliary mounting ridge 636 and reads the user's data stored on NFC tag 616. In such an embodiment, an accessory is supported by another slot 638 of the auxiliary mounting ridge 636. In various other embodiments, a component including storage (e.g., memory) and a communications interface is permanently coupled to the user's hard hat. In such embodiments, when the communicator 614 is connected to the component coupled to the hard hat, personalized information is read from the storage 616. In a specific embodiment, NFC tag 616 is embedded in hard hat 600.

Figure 15:
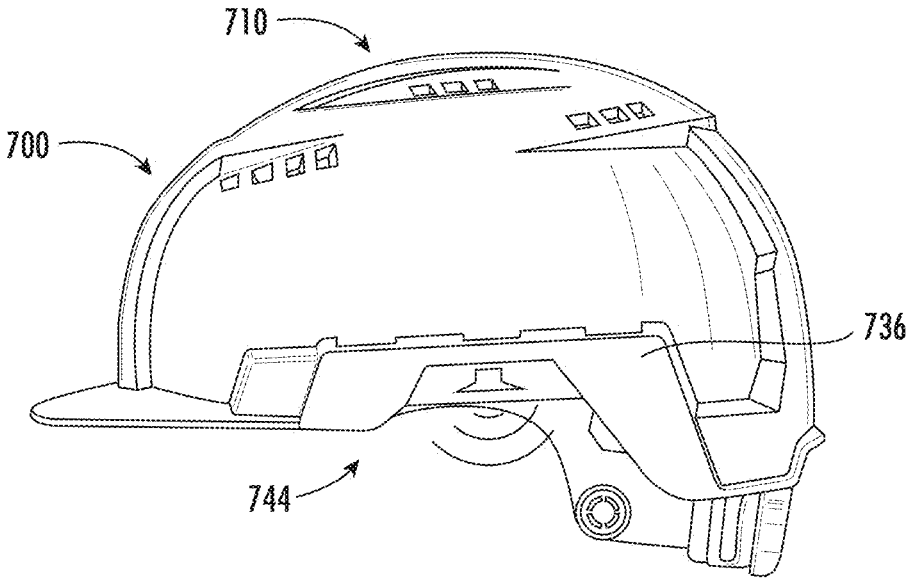
FIG. 15 is a side view of a hard hat supporting a communication system, according to another exemplary embodiment.
Figure 16:
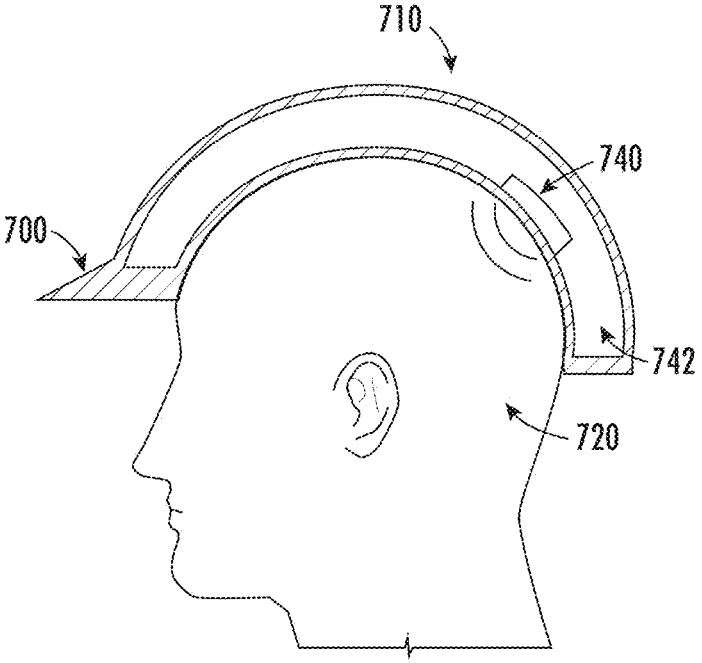
FIG. 16 is a cross-sectional view of the hard hat of FIG. 15, according to an exemplary embodiment.

Referring to FIGS. 15-16, a side view of a protective work or construction helmet, shown as hard hat 700 supporting a communication system 710 is shown, according to an exemplary embodiment. Hard hat 700 is substantially the same as hard hat 100 except for the differences discussed herein. Communication system 710 includes bone conduction transducer(s) 740 integrated into the hard hat lining or foam 742. Applicant believes the position of the bone conduction transducer(s) 740 couples the audio vibration into the user's 720 bone structure. The bone conduction transducer can be utilized with an air-conducted audio component shown as speaker 744.

Figure 17:
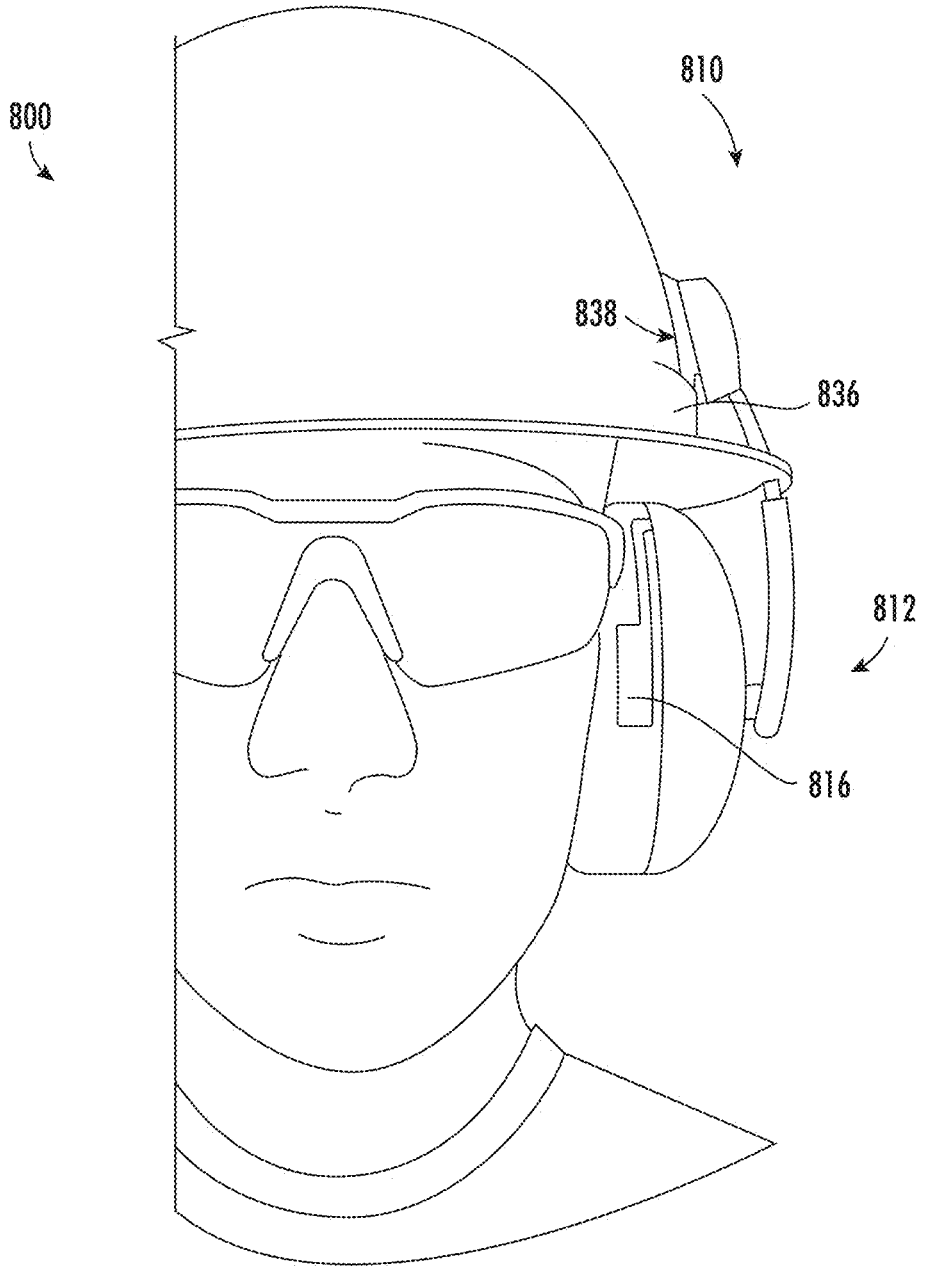
FIG. 17 is a front perspective view of a hard hat supporting a communication system on the head of a wearer, according to another exemplary embodiment.
Figure 18:
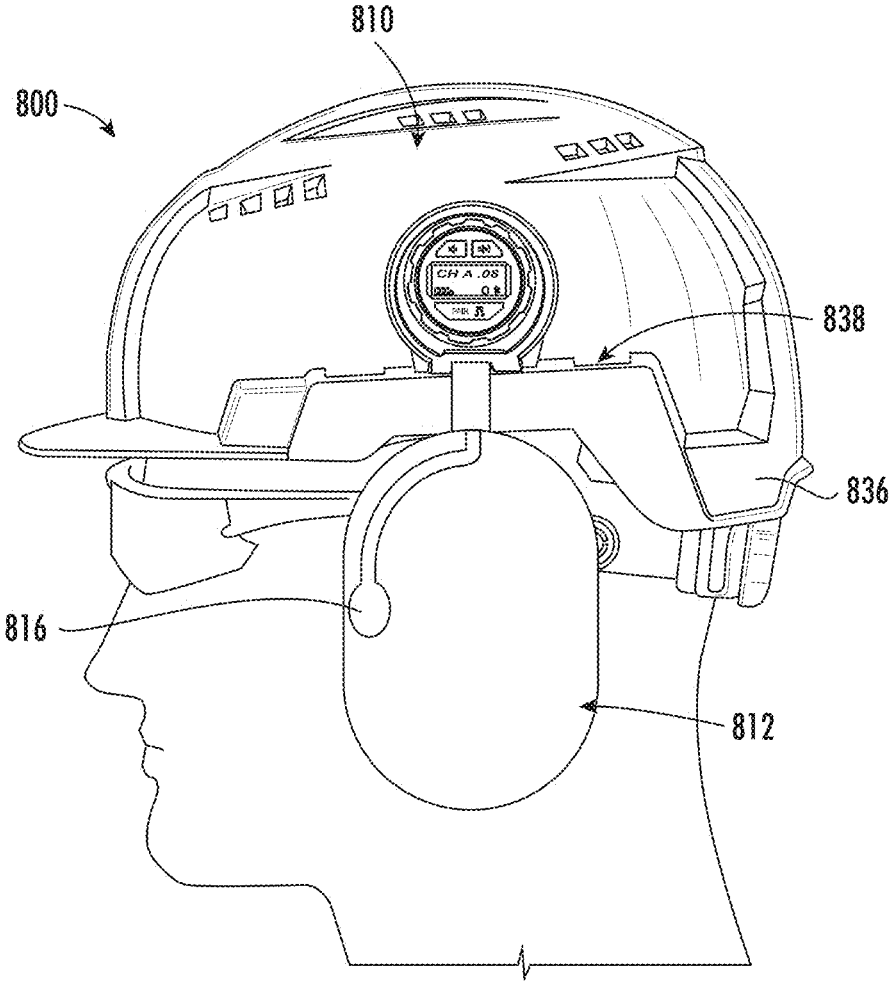
FIG. 18 is a side perspective view of the hard hat supporting a communication system of FIG. 17, according to an exemplary embodiment.

Referring to FIGS. 17-18, perspective views of a protective work or construction helmet, shown as hard hat 800 supporting a communication system 810 is shown, according to an exemplary embodiment. Hard hat 800 is substantially the same as hard hat 100 except for the differences discussed herein. Communication system 810 includes an earmuff 812. Earmuff 812 includes a bone conduction transducer 816 integrated into earmuff 812.

Figure 19:
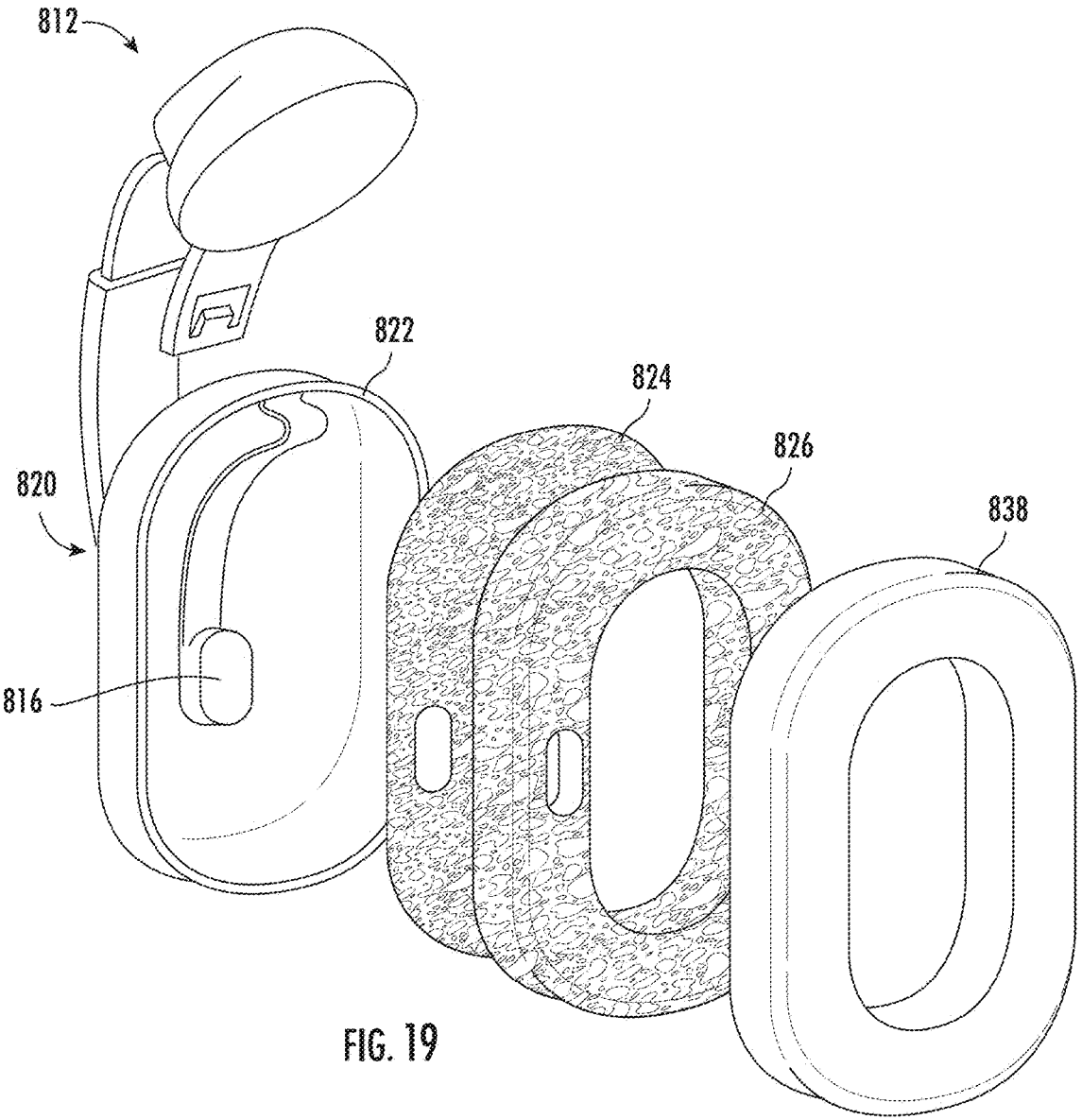
FIG. 19 is an exploded view of a portion of the communication system in an earmuff, according to an exemplary embodiment.

Referring to FIG. 19, details of earmuff 812 are shown, according to an exemplary embodiment. Earmuff 812 includes a body, shown as rigid body 820. Bone conduction transducer 816 is coupled to rigid body 820 of earmuff 812. In various specific embodiments, bone conduction transducer 816 is coupled to a top arc 822 of rigid body 820. In a specific embodiment, top arc 822 has a concave orientation and faces a bottom arc of rigid body 820. Earmuff 812 further includes a mesh layer 824, a foam layer 826, and a foam cover 828.

Referring generally to the figures, various embodiments of a hard hat communication system are provided. In contrast to typical chargers and/or docking stations designed to be used in a single location, the charger and/or docking station discussed herein is configured for mobility. In various specific embodiments, the charger and/or docking station is configured to fit within a storage container, such as a modular storage container. In a specific embodiment, the charger and/or docking station is configured to be used with a mobile power source, such as a power tool battery to allow for a mobile charging system.

In various embodiments, when the communication system allows for connecting and disconnecting the communication system or device (e.g., with a magnet or simple audio jack/connector) the communicator is couplable to a mounting bracket. In such embodiments, the mounting bracket is configured to be mounted on a mounting ridge, such as a rear mounting ridge of a hard hat. In various embodiments, the headset of the communication system is removably coupled to a clip mounted to the hard hat. In such embodiments, the headset can be clipped to the user's ear while in use and clipped to the helmet when in a storage position. Applicant believes the mounting of the communication system on the rear and/or side of the hard hat allows a user to quickly and easily put on and remove (i.e., don and doff) the headset while reducing the likelihood of the device becoming entangled.

In various specific embodiments, the bone conduction transducers are integrated into the head protection. In such embodiments, the communicator is removably couplable to the head protection such that the communicator can be removed and returned at the end of a work day. In various embodiments, the communicator can be paired with another device, such as Bluetooth pairing with a phone and/or app. In various embodiments, the communication system allows for private channels. Applicant believes that private communication channels that are separated by locked teams allow for easy secure communication on a worksite that may include a number of different teams and/or companies. In various embodiments, the communication system allows for public channels that are open to all workers on a jobsite.

Referring to FIGS. 20-21, details of a charging system 900 are shown according to an exemplary embodiment. Charging system 900 can be utilized with be utilized with communication systems 10, 110, 210 and 310, etc. In various embodiments, a charger or base station 922 is configured to receive and charge one or more headsets 912 and communicators 914. In various embodiments, the charging system includes more than one charger or base stations 922. Each charger 922 includes one or more bays 926 sized to receive a headset 912 and a communicator 914. In various embodiments, charger 922 allows for pairing of headsets 912 and communicators 914 in the same manner previously discussed regarding charging system 11.

In various embodiments, charger 922 is configured to fit within a storage container, such as a modular storage container 930. In various specific embodiments, modular storage container 930 includes a pivotable lid 932 and a base 934. In various specific embodiments, charging system 900 and/or modular storage container 930 includes a section 936 configured to support a mobile power source, shown as power tool battery 938.

Figure 22:
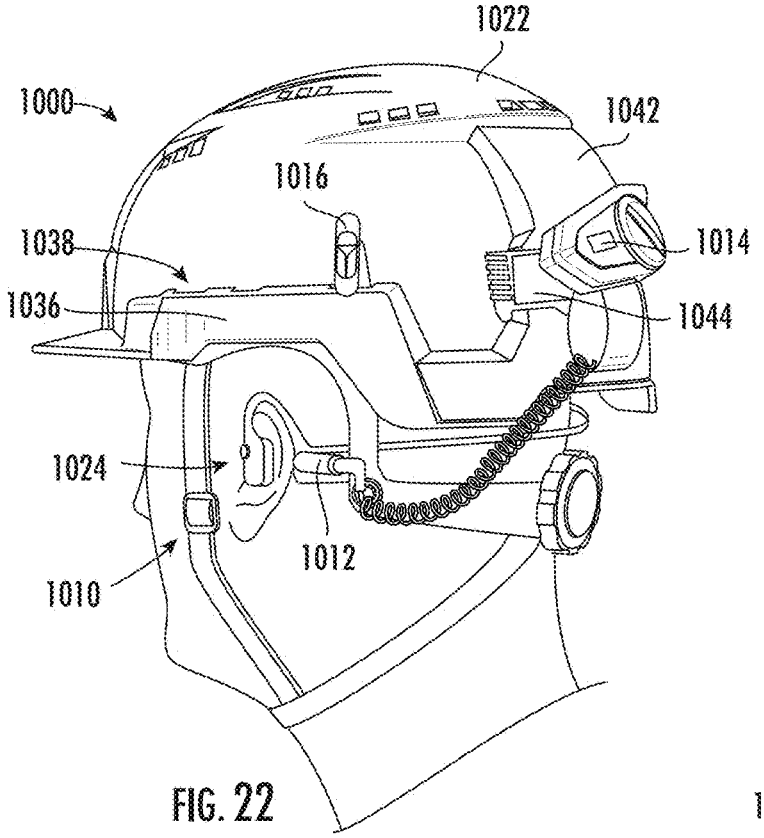
FIG. 22 is a rear perspective view of a hard hat supporting a communication system on the head of a wearer, according to another exemplary embodiment.
Figure 23:
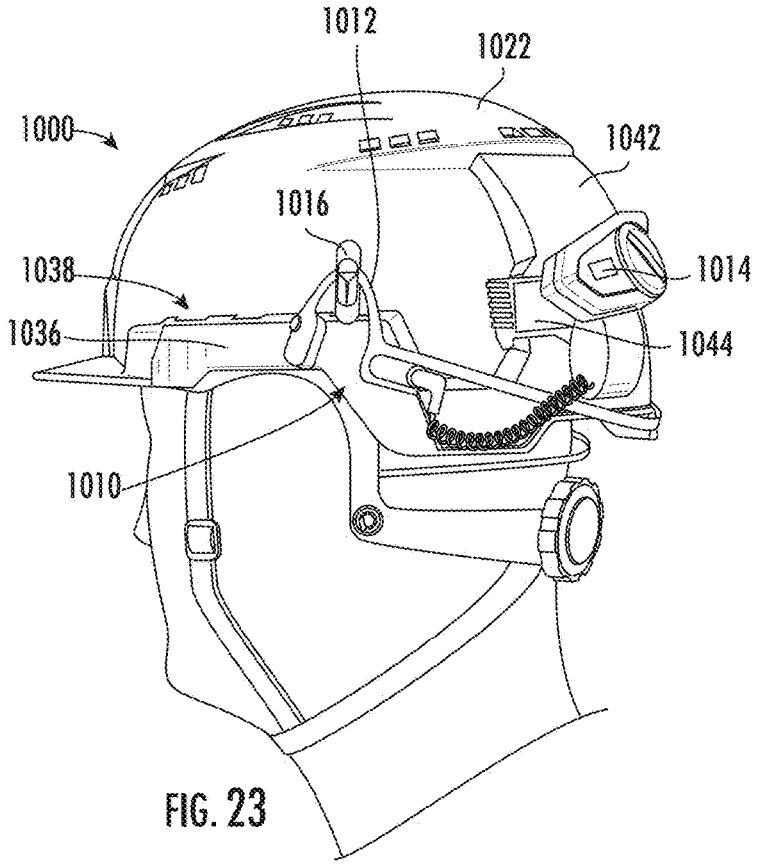
FIG. 23 is a rear perspective view of the hard hat supporting the communication system of FIG. 22 in a storage position, according to an exemplary embodiment.
Figure 24:
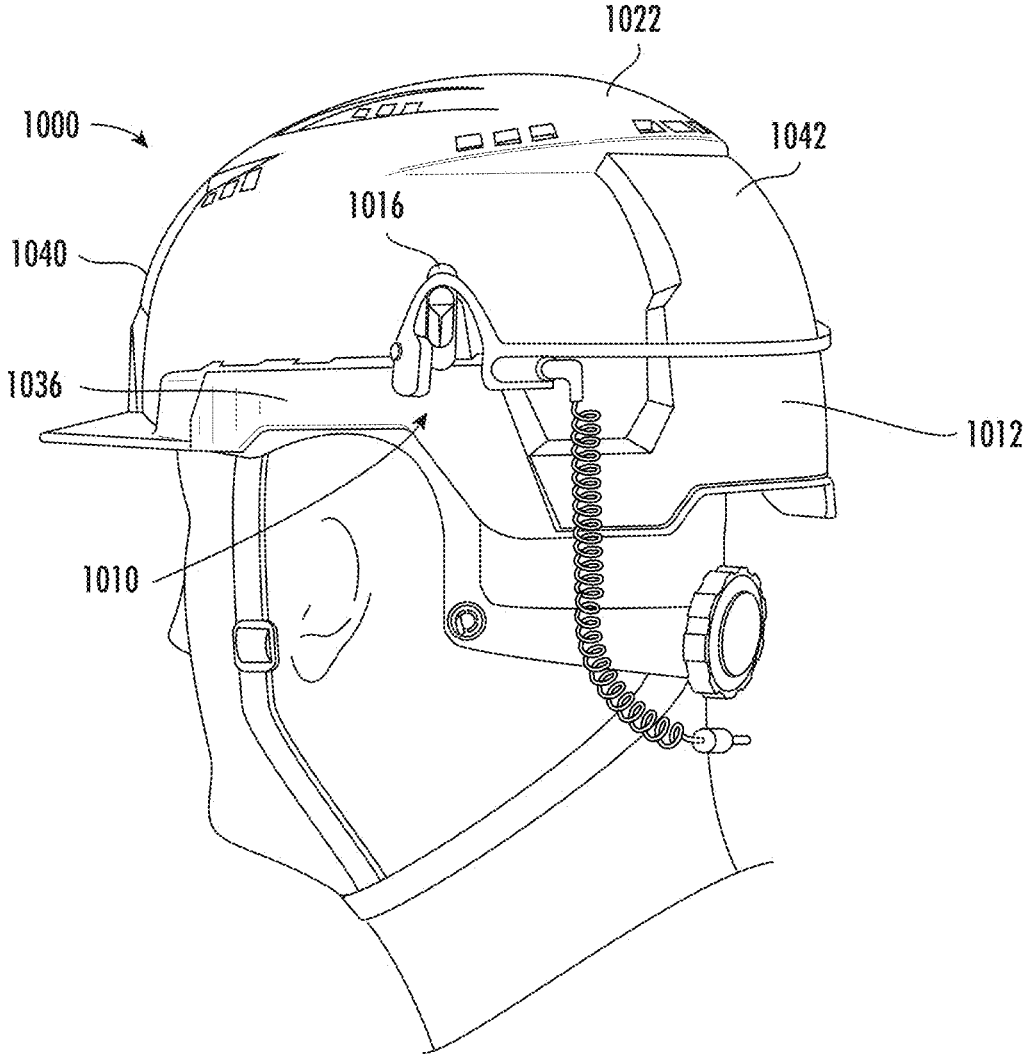
FIG. 24 is a rear perspective view of the hard hat supporting the communication system of FIG. 22 with the communicator removed, according to an exemplary embodiment.

Referring to FIGS. 22-24, details of a hard hat 1000 supporting a communication system 1010 are shown according to an exemplary embodiment. Hard hat 1000 is substantially the same as hard hat 100, 200, 300 except for the differences discussed herein. The communication system 1010 includes a communication device or communicator 1014 that can be paired with a headset 1012. In specific embodiments, headset 1012 is mounted to hard hat 1000 by a clip 1016.

In various embodiments, hard hat 1000 includes a front mounting ridge 1040 positioned on the front 1028 of outer shell 1022. Front mounting ridge 1040 is substantially the same as front mounting ridge 140 except for the differences discussed herein. In various embodiments, hard hat 1000 includes a rear mounting ridge 1042 that is substantially the same as front mounting ridge 1040 except for the differences discussed herein.

In various embodiments, hard hat 1000 includes a side accessory support ridge or auxiliary mounting ridge 1036 is positioned on a lateral side of outer shell 1022 along a bottom segment 1024. In various embodiments, an auxiliary mounting ridge 1036 is positioned along both lateral sides of outer shell 1022. Auxiliary mounting ridge 1036 includes a first end and a second end opposing the first end. A plurality of apertures or slots 1038 are positioned along auxiliary mounting ridge 1036 between the first end and the second end. In a specific embodiment, auxiliary mounting ridge 1036 includes three slots.

The communicator 1014 is couplable to a mounting bracket 1044. In such embodiments, the mounting bracket 1044 is configured to be mounted on a mounting ridge, such as the rear mounting ridge 1042 of hard hat 1000. In other words, the communicator 1014 is coupled to a mounting ridge vis a mounting bracket 1044. In various embodiments, the headset 1012 of the communication system 1010 is removably coupled to the clip 1016 mounted to the hard hat 1000. In such embodiments, the headset 1012 can be clipped to the user's ear while in use (see e.g., FIG. 22) and clipped to the helmet when in a storage position (see e.g., FIG. 22). In other words, when headset 1012 is in an active position, headset 1012 is configured to be supported by the wearer/user and when headset 1012 is in a storage position, headset 1012 is supported by a mounting ridge such as the auxiliary mounting ridge.

Figure 25:
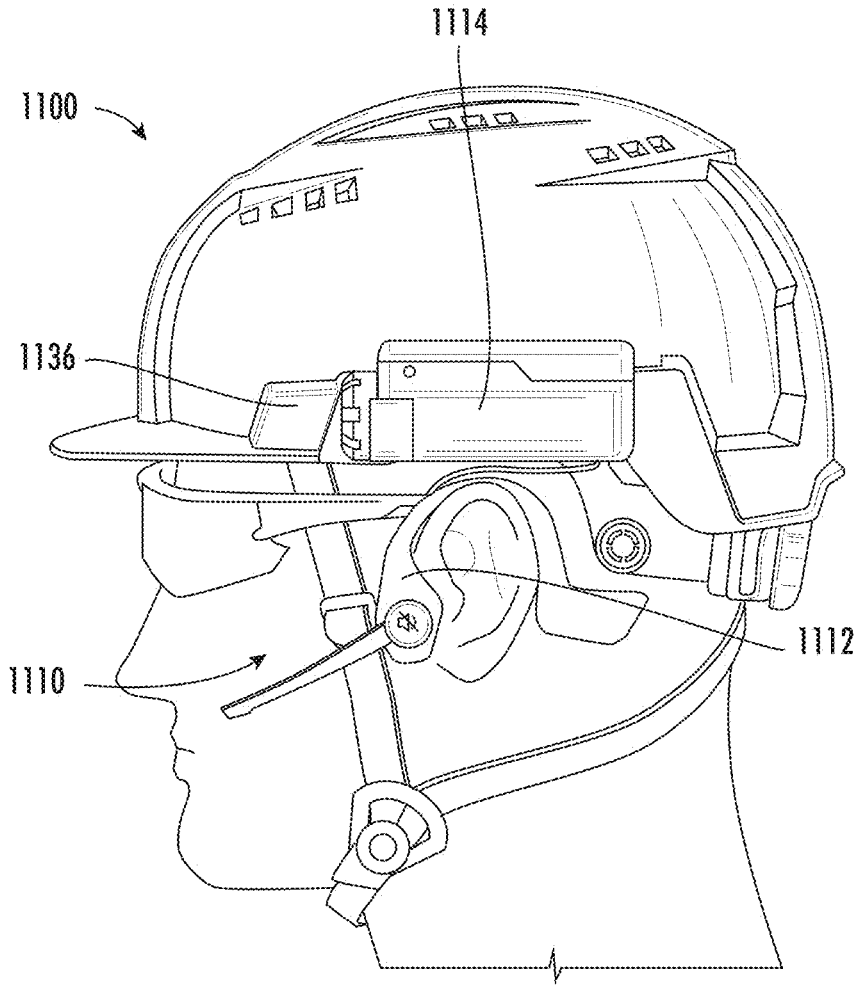
FIG. 25 is a side view of a hard hat supporting a communication system on the head of a wearer, according to another exemplary embodiment.
Figure 26:
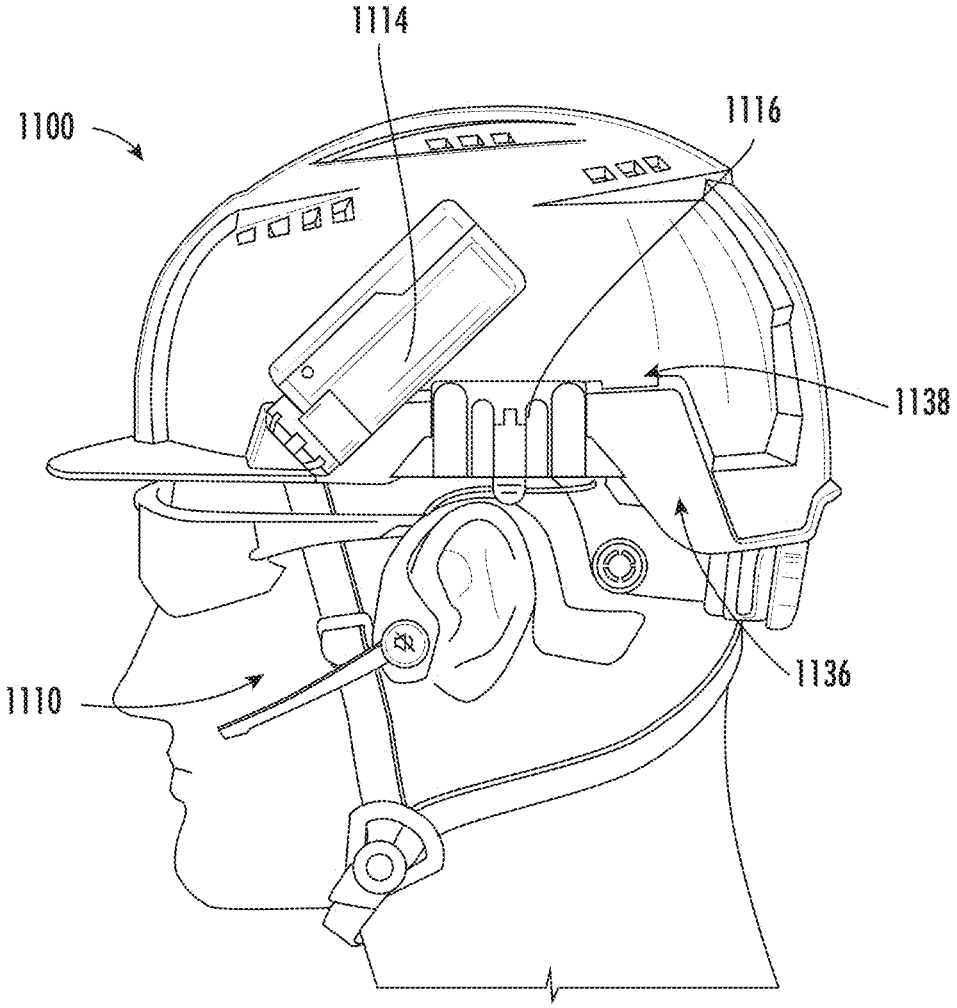
FIG. 26 is a side view of the hard hat supporting the communication system of FIG. 25 with the communicator removed, according to an exemplary embodiment.
Figure 27:
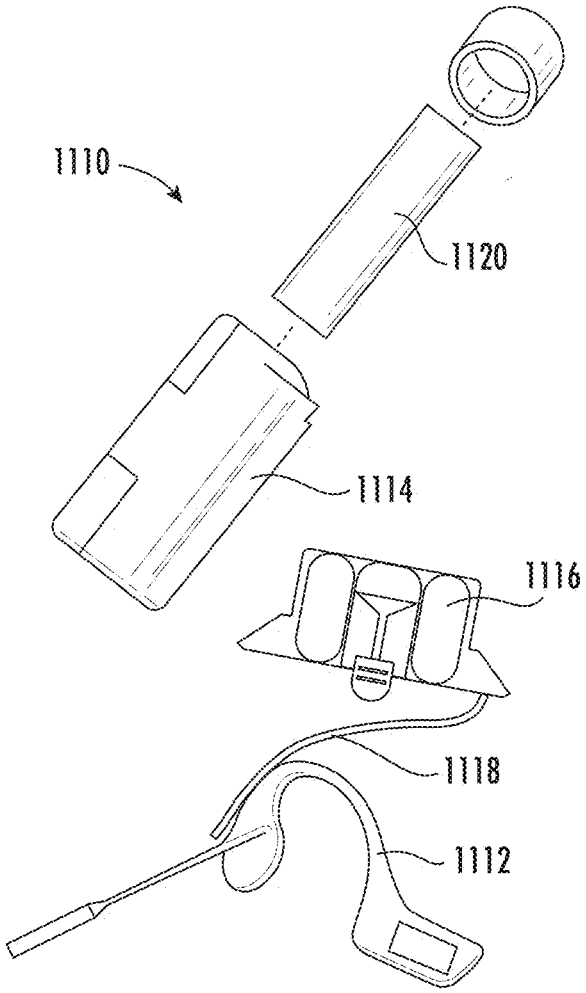
FIG. 27 is an exploded view of the communication system of FIG. 25, according to an exemplary embodiment.

Applicant believes the positioning of communicator 1014 and headset 1012 on and adjacent to the rear of helmet 1000 allows a user to easily put on and take off headset 1012 without entanglement of headset 1012. Furthermore, when communicator 1014 is charging, headset 1012 can be clipped in the storage position along the rear of hard hat 1000 in a convenient position that avoids entanglement of headset 1012 (see e.g., FIG. 23). Referring to FIGS. 25-27, details of a hard hat 1100 supporting a communication system 1110 are shown according to an exemplary embodiment. Hard hat 1100 is substantially the same as hard hat 100, 200, 300, 100 except for the differences discussed herein. The communication system 1110 allows for connecting and disconnecting the communication system 1110 or communication device 1014 at different times reducing the likelihood of the communicator 1114 becoming entangled and allowing for quick and easy removal and storage of communicator 1114 at the end of the work day.

In various specific embodiments, when communicator 1114 is positioned removably coupled to auxiliary mounting ridge 1136. In a specific embodiment, a longitudinal axis of communicator 1114 extends along a longitudinal axis and/or a lateral side of hard hat 1100 when communicator 1114 is coupled to hard hat 1100. In various embodiments, communicator 1114 is coupled to a helmet clip 1116 that is engaged with auxiliary mounting ridge 1136. In a specific embodiment, helmet clip 1116 is at least partially received and/or supported within a slot 1138 of auxiliary mounting ridge 1136.

As shown in FIG. 27, headset 1112 is connected to helmet clip 1116 by a flexible connector, shown as wire 1118. In various embodiments, communicator 1114 is powered by a battery 1120 that is removable from communicator 1114. In various specific embodiments, battery 1120 is a rechargeable battery.

Figure 28:
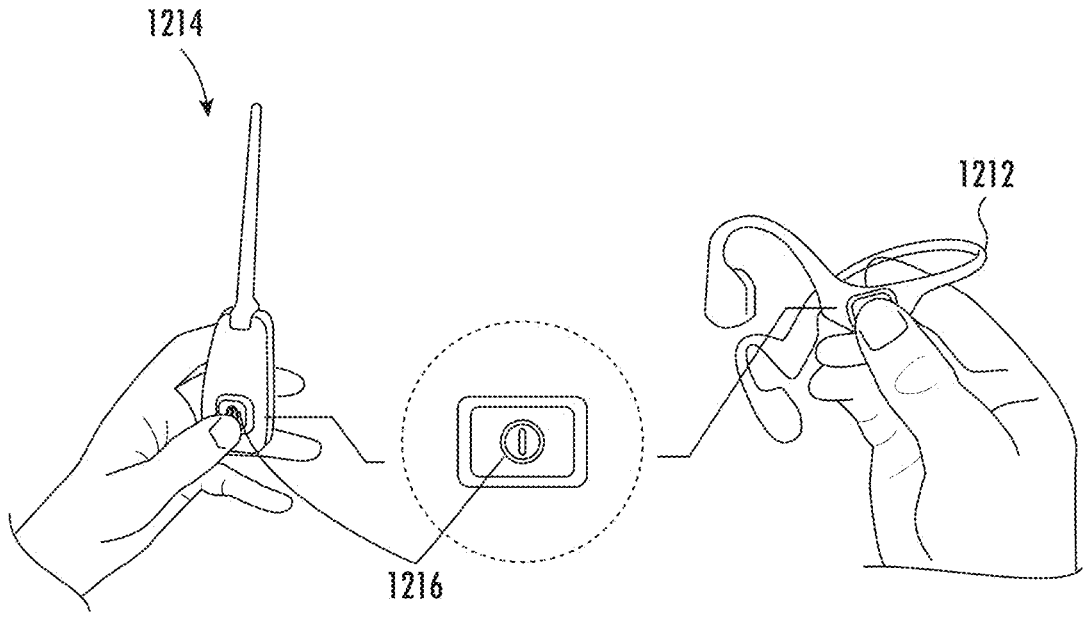
FIG. 28 is a perspective view of powering on devices of a communication system, according to another exemplary embodiment.
Figure 29:
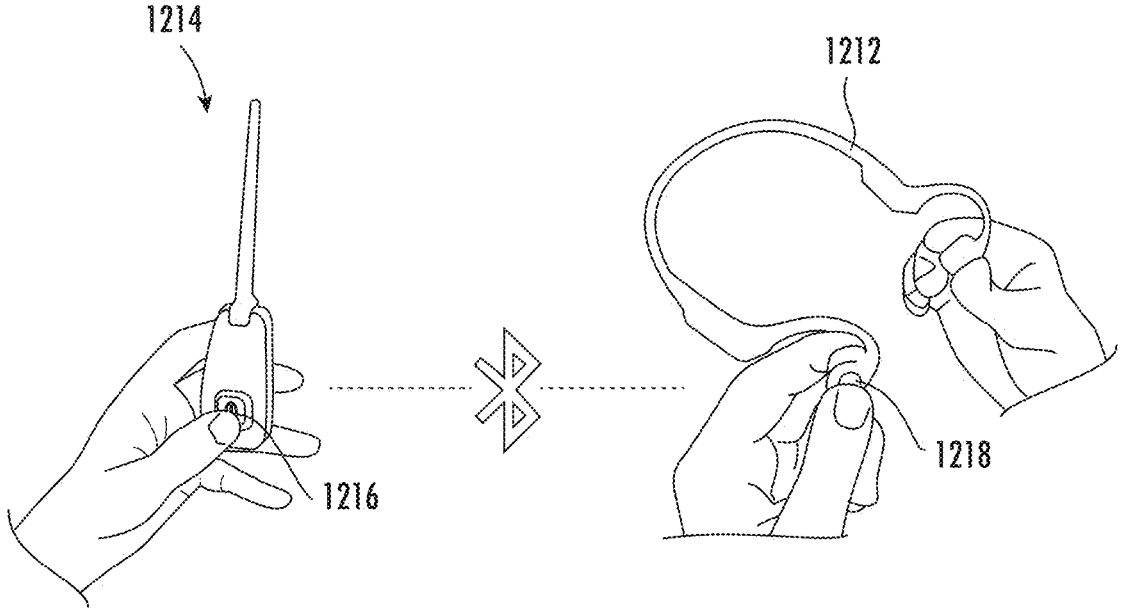
FIG. 29 is a perspective view of pairing the devices of the communication system of FIG. 28, according to an exemplary embodiment.

Referring to FIGS. 28-29, in various embodiments, a communicator 1214 (e.g., a remote, phone and/or app, etc.) can be paired with another device, such as Bluetooth pairing with a headset 1212. In various specific embodiments, a user actuates a power button 1216 and holds for a time in order to turn on communicator 1214. In a specific embodiment, the user holds the power button 1216 for three seconds to power on the communicator 1214. In other embodiments, the user holds the power button 1216 for a different amount of time (e.g., 2 second, 4 seconds, 5 seconds, etc.) to power on the communicator 1214.

In various specific embodiments, to pair the communicator 1214 with the headset 1212 a pairing button 1218 is actuated after the communicator 1214 has been powered on. In a specific embodiment, the user holds the pairing button 1218 for five seconds to pair headset 1212 with communicator 1214. In other embodiments, the user holds the pairing button 1218 for a different amount of time (e.g., 3 second, 4 seconds, 6 seconds, etc.) to pair the communicator 1214 and headset 1212.

Figure 30:
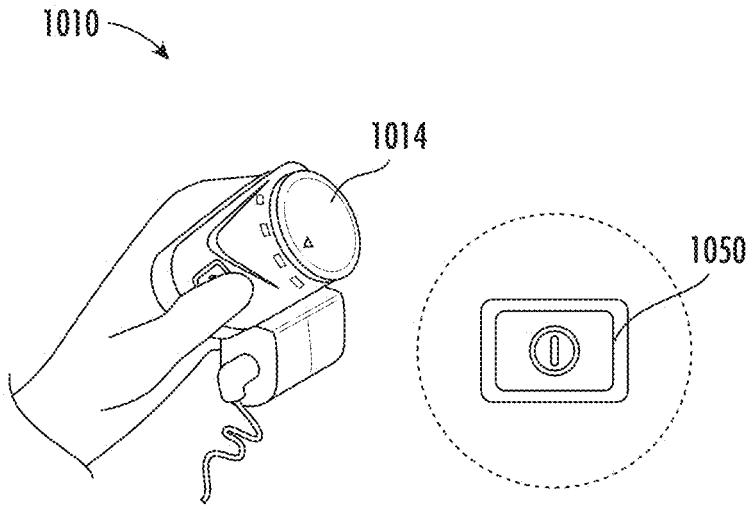
FIG. 30 is a perspective view of powering on a communicator of a communication system, according to another exemplary embodiment.
Figure 31:
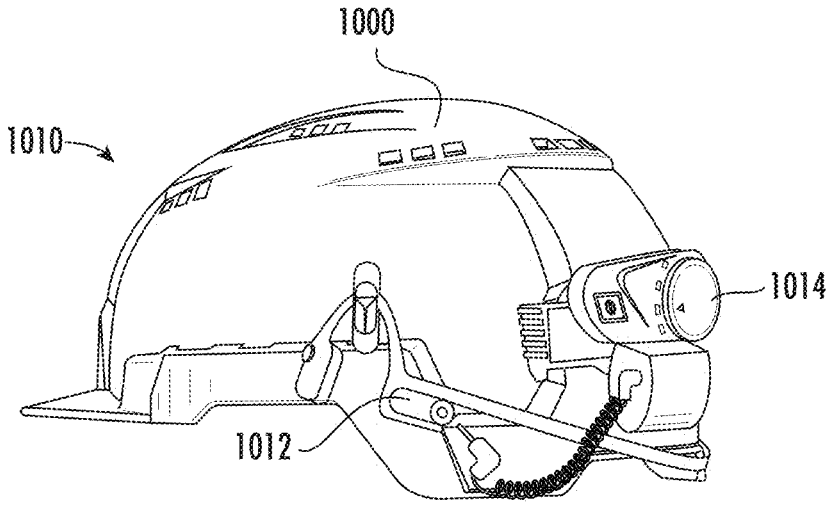
FIG. 31 is a perspective view of connecting the communicator of FIG. 30 to a headset supported by a hard hat, according to an exemplary embodiment.

Referring to FIGS. 30-31, details of powering on a communication system, such as communication system 1010, is shown according to an exemplary embodiment. In various embodiments, communicator 1014 can be paired with another device, such as Bluetooth pairing with headset 1012. In various specific embodiments, a user actuates a power button 1050 and holds for a time in order to turn on communicator 1014. In a specific embodiment, the user holds the power button 1050 for three seconds to power on the communicator 1014. Once communicator 1014 has been powered on, a user can connect or plug communicator 1014 into headset 1012 to prepare communication system 1010 for use.

Figure 32:
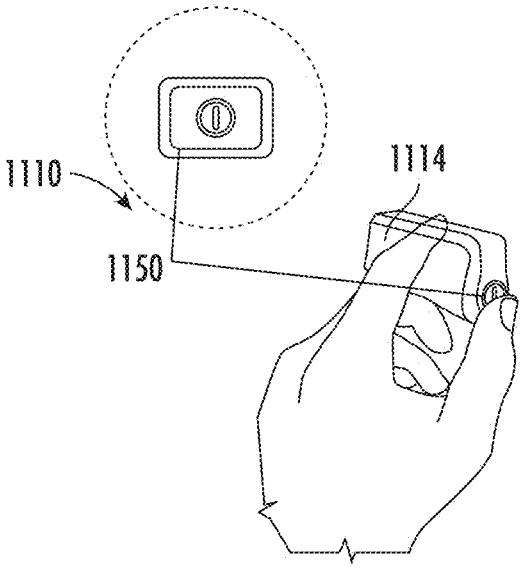
FIG. 32 is a perspective view of powering on a communicator of a communication system, according to another exemplary embodiment.
Figure 33:
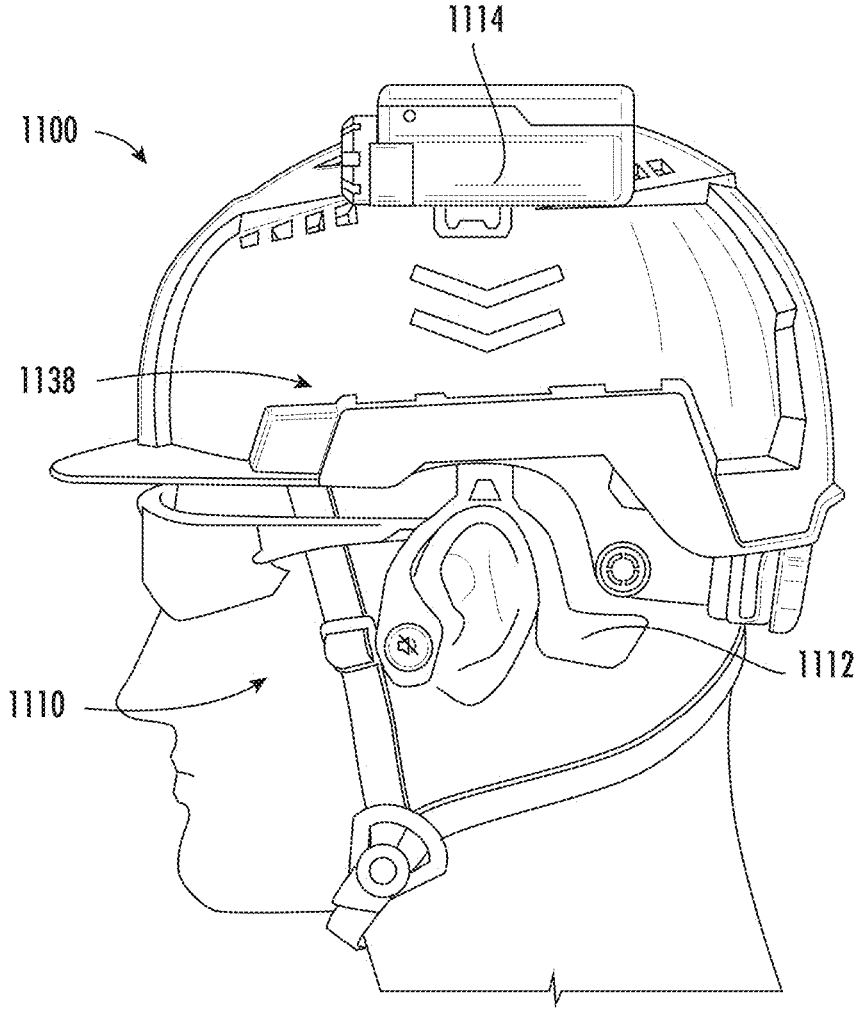
FIG. 33 is a perspective view of connecting the communicator of FIG. 32 to a headset supported by a hard hat, according to an exemplary embodiment.

Referring to FIGS. 32-33, details of powering on a communication system, such as communication system 1110, is shown according to an exemplary embodiment. In various embodiments, communicator 1114 can be paired with another device, such as Bluetooth pairing with headset 1112. In various specific embodiments, a user actuates a power button 1150 and holds for a time in order to turn on communicator 1114. In a specific embodiment, the user holds the power button 1150 for three seconds to power on the communicator 1114. Once communicator 1114 has been powered on, a user can connect or plug communicator 1014 into hard hat 1100 and specifically into slot 1138 to connect to headset 1112 and prepare communication system 1110 for use.

Figure 34:
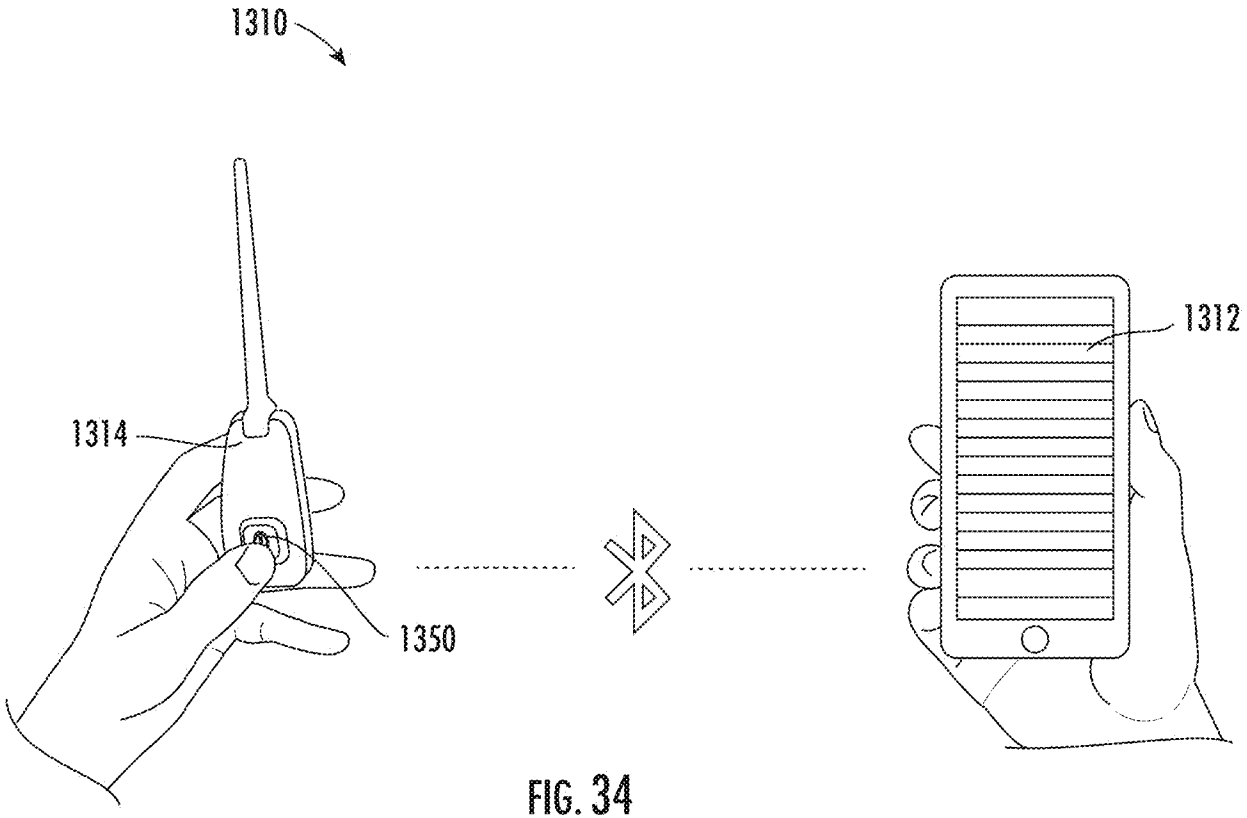
FIG. 34 is a perspective view of pairing devices of a communication system, according to another exemplary embodiment.
Figure 35:
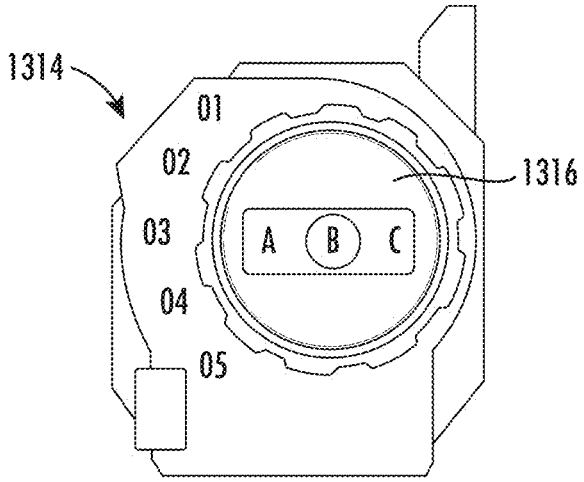
FIG. 35 is a side view of adjusting a communicator, according to another exemplary embodiment.
Figure 36:
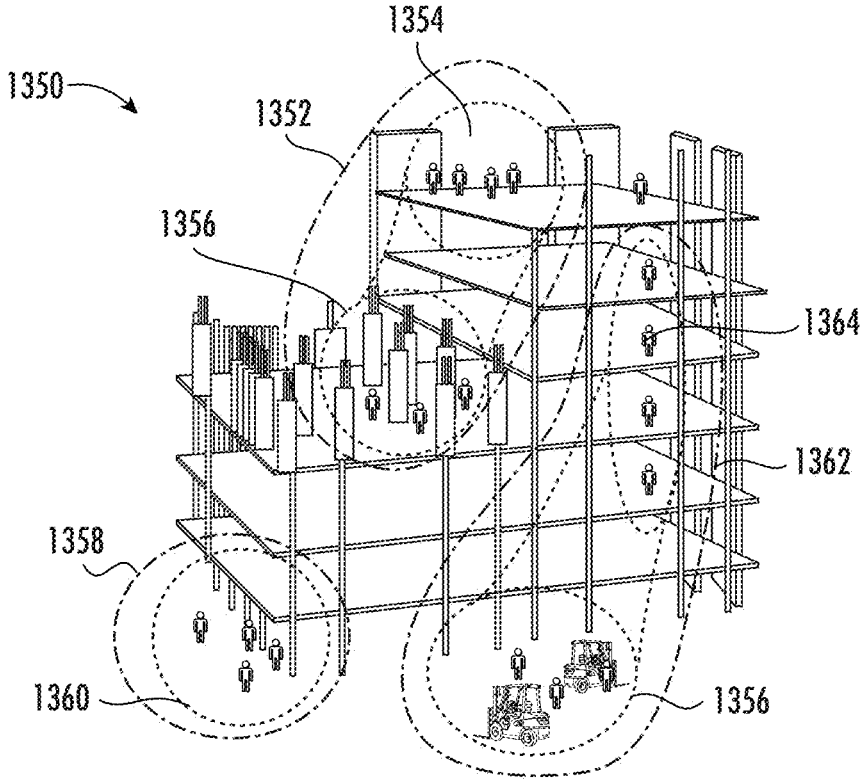
FIG. 36 is a schematic view of private communication channels on a worksite according to an exemplary embodiment.

Referring to FIGS. 34-36, details of a communication system 1310 that allows for communication over private channels is shown according to an exemplary embodiment. Applicant believes that private communication channels that are separated by locked teams allow for easy secure communication on a worksite that may include a large number of workers on different teams and/or for separate companies.

In various specific embodiments, communication system 1310 allows for pairing, such as Bluetooth pairing, with a communicator 1314 to a device 1312 application, such as a phone application. In various specific embodiments, to pair the communicator 1314 with the device 1312 a pairing button 1350 is actuated after the communicator 1314 has been powered on. In a specific embodiment, the user holds the pairing button 1350 for five seconds to pair the device 1312 with communicator 1314.

Referring to FIG. 35, in various embodiments, communicator 1314 includes a dial that can be rotated in a clockwise and/or counterclockwise direction to alter the settings of communicator 1314. In a specific embodiment, when dial 1316 is rotated the communicator 1314 adjusts the communication channel.

For example, as shown in FIG. 36, on a work site 1350 multiple companies may be completing work simultaneously. A first company 1352 includes a first team 1354 and a second team 1356. The first team 1354 communicates over channel 2 and the second team 1356 communicates over channel 3. In other words, each team within first company 1352 is able to communicate freely within their team without interruption. On the same work site 1350, a second company 1358 has a third team 1360 that communicates within a locked channel 3 and can communicate without interruption from first team 1354. Additionally, a third company 1362 with a fourth team 1364 and fifth team 1366 communicate over separate channels.

Figure 37:
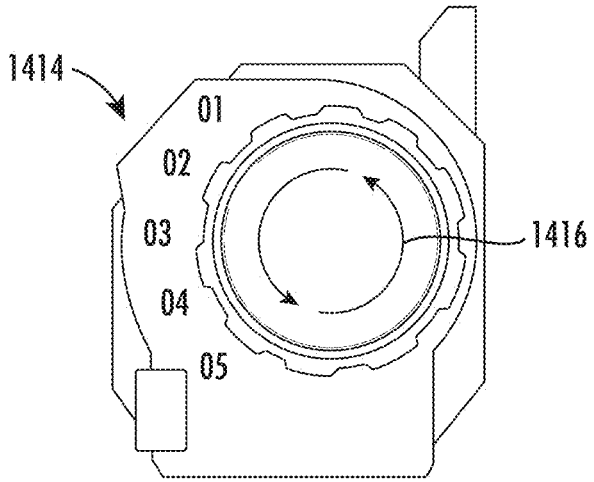
FIG. 37 is a side view of adjusting a communicator, according to another exemplary embodiment.

Referring to FIG. 37, in various embodiments, communicator 1414 includes a dial 1416 that can be rotated in a clockwise and/or counterclockwise direction to alter the settings of communicator 1414. In a specific embodiment, when dial 1416 is rotated the communicator 1414 adjusts the public communication channel. The public communication channels allow for fluid and open communication across a work site (see e.g., work site 1450 in FIG. 38).

Figure 38:
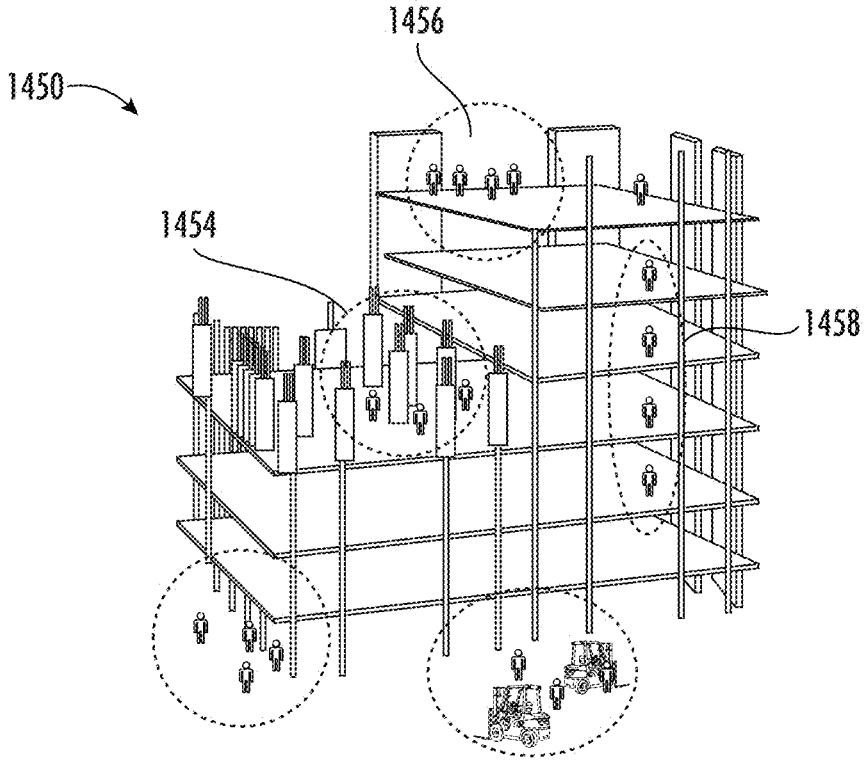
FIG. 38 is a schematic view of public communication channels on a worksite according to an exemplary embodiment.

As shown in FIG. 38, work site 1450 has open communication. In other words, even though a first team 1454 is communicating on a first channel, members of first team 1454 can still access the communication of a second team 1456 communicating on a second channel and a third team 1458 communicating on a third channel.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature. As used herein, "rigidly coupled" refers to two components being coupled in a manner such that the components move together in a fixed positional relationship when acted upon by a force.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A hard hat system, comprising:
- a hard hat comprising:
  - an outer shell, the outer shell comprising:
    - an exterior surface;
    - an interior surface defining a cavity, the cavity configured to receive a head of a wearer;
    - a crown comprising:
      - a front side; and
      - a rear side, wherein the crown is configured to cover part of the head of the wearer, wherein a bottom portion of the crown defines a lower circumference along the exterior surface;
  - a mounting ridge extending outward from at least one of the front side and the rear side of the exterior surface of the hard hat, the mounting ridge comprising a first edge spaced apart from the exterior surface and a second edge spaced apart from the exterior surface; and
  - an auxiliary mounting ridge positioned on a lateral side of the bottom portion of the crown, the auxiliary mounting ridge comprising:
    - a plurality of mounting ports positioned along the auxiliary mounting ridge;
- a communication system, the communication system comprising:
  - a communicator, the communicator supported by the mounting ridge or the auxiliary mounting ridge; and
  - a headset, wherein the headset is configured to be used with the communicator.

2. The hard hat system of claim 1, wherein the communicator is coupled to the mounting ridge via a mounting bracket.

3. The hard hat system of claim 1, wherein, when the headset is in an active position, the headset is configured to be supported by the wearer and wherein, when the headset is in a storage position, the headset is supported by the auxiliary mounting ridge.

4. The hard hat system of claim 1, wherein an accessory is supported by the mounting ridge or the auxiliary mounting ridge.

5. The hard hat system of claim 1, wherein the communication system further comprises a bone conduction transducer integrated in the hard hat.

6. The hard hat system of claim 5, wherein the bone conduction transducer is integrated into the outer shell.

7. The hard hat system of claim 1, wherein the communicator is supported by one of the plurality of mounting ports of the auxiliary mounting ridge.

8. The hard hat system of claim 7, wherein the communicator is connected to the headset by a wire.

9. A hard hat system, comprising:
- a hard hat comprising:
  - an outer shell, the outer shell comprising:
    - an exterior surface;
    - an interior surface defining a cavity sized to receive a head of a user;
    - a crown portion configured to cover part of the head of the user, wherein a bottom segment of the crown portion defines a lower circumference extending along the exterior surface of the outer shell;
  - a mounting ridge positioned on a lateral side of the bottom segment, the mounting ridge comprising:
    - a first end;
    - a second end; and
    - a plurality of slots positioned along the mounting ridge between the first end and the second end;
- a communicator, the communicator supported by the mounting ridge; and
- a headset, wherein the headset is configured to be used with the communicator.

10. The hard hat system of claim 9, wherein the communicator is coupled to and supported by one of the plurality of slots of the mounting ridge.

11. The hard hat system of claim 9, wherein the headset is coupled to the mounting ridge.

12. The hard hat system of claim 9, wherein the communicator is connected to the headset by a wire.

13. The hard hat system of claim 12, wherein the wire includes a magnetic component that is configured to magnetically couple to a magnetic dock on the headset.

14. The hard hat system of claim 9, further comprising a clip, wherein the clip is removably coupled to the mounting ridge and configured to support the headset along the exterior surface of the outer shell when the headset is in a storage position.

15. The hard hat system of claim 9, wherein a longitudinal axis of the communicator extends along the lateral side of the outer shell.

16. A hard hat system, comprising:
- a hard hat comprising:
  - an outer shell, the outer shell comprising:
    - an exterior surface;
    - an interior surface defining a cavity;
    - a crown portion comprising a bottom segment that defines a lower circumference extending along the exterior surface of the outer shell;
  - a mounting ridge positioned on a lateral side of the bottom segment, the mounting ridge comprising:
    - a first end;
    - a second end; and
    - at least two slots positioned along the mounting ridge between the first end and the second end;
- a communicator, the communicator supported by one of the at least two slots of the mounting ridge; and
- a headset, the headset is configured to be supported by the hard hat.

17. The hard hat system of claim 16, further comprising a near-field communication tag positioned on the exterior surface of the hard hat adjacent to the mounting ridge, wherein the near-field communication tag is configured to store a user's data.

18. The hard hat system of claim 17, wherein, when the communicator is supported by the one of the at least two slots of the mounting ridge, the communicator is configured to read the user's data stored on the near-field communication tag.

19. The hard hat system of claim 16, further comprising an accessory supported by the other of the at least two slots of the mounting ridge.

20. The hard hat system of claim 16, further comprising a clip, wherein the clip is removably coupled to the mounting ridge and configured to support the headset along the exterior surface of the outer shell.

* * * * *